US005937928A

United States Patent [19]

Chou

[11] Patent Number: 5,937,928

[45] **Date of Patent: *Aug. 17, 1999**

[54] MULTIPLE PULL ROD MULTIPLE VANE POSITIVE CLOSE CONTROL FOR A VERTICAL BLIND

[76] Inventor: Tser-Wen Chou, 19464 Via Del Caballo, Yorba Linda, Calif. 92686

[ * ] Notice: This patent is subject to a terminal disclaimer.

[21] Appl. No.: 08/940,284

[22] Filed: Sep. 30, 1997

Related U.S. Application Data

[63] Continuation-in-part of application No. 08/825,648, Apr. 3, 1997, Pat. No. 5,848,632.

[51] Int. Cl.[6] ..... E06B 9/38

[52] U.S. Cl. ..... 160/168.1 V; 160/176.1 V; 160/900

[58] Field of Search ..... 160/168.1 V, 173 V, 160/176.1 V, 177 V, 344, 115, 178.1 V, 900

[56] References Cited

U.S. PATENT DOCUMENTS

| | | | |
|---|---|---|---|
| 2,419,486 | 4/1947 | Dixon | 160/341 |
| 3,208,507 | 9/1965 | Breen | 160/168.1 V |
| 3,500,896 | 3/1970 | Endou | 160/900 X |
| 4,293,021 | 10/1981 | Arena | 160/900 X |
| 4,316,493 | 2/1982 | Arena | 160/900 X |
| 4,332,288 | 6/1982 | Frentzel et al. | 160/176.1 V |
| 4,449,564 | 5/1984 | Hansen et al. | 160/168.1 V |
| 4,662,422 | 5/1987 | Anderson | 160/178.1 V X |
| 4,742,860 | 5/1988 | Debs | 160/178.1 V |
| 4,791,703 | 12/1988 | Chang | 160/178.1 V X |
| 5,170,531 | 12/1992 | Ryan | 160/341 X |
| 5,577,542 | 11/1996 | Hung | 160/900 X |
| 5,647,422 | 7/1997 | Weng | 160/900 X |
| 5,699,846 | 12/1997 | Ohanesian | 160/900 X |

*Primary Examiner*—David M. Purol
*Attorney, Agent, or Firm*—Curtis L. Harrington

[57] ABSTRACT

An improved system utilizes a series of structures which permit magnetic closure to be used in existing carriers and components. Magnetic support structures include members which ride in the carrier, as well as special size members which mount in the lead or wand carrier and which reside in the vertical blind track end caps. All of the structures are installable as retro-fit and which can work with existing tracks, carriers and end caps, even though these structures have been optimized for small size.

4 Claims, 27 Drawing Sheets

MULTIPLE PULL ROD MULTIPLE VANE POSITIVE CLOSE CONTROL FOR A VERTICAL BLIND

RELATED APPLICATION

This Application is a Continuation In Part of U.S. patent application Ser. No. 08/825,648 filed on Apr. 3, 1997 now U.S. Pat. No. 5,848,632.

FIELD OF THE INVENTION

The present invention relates to the field of window coverings and more particularly for improvements in control for various orientational combinations, and which permits a multi-section structure to achieve complete closure. More particularly the invention relates to plurality and higher wand controls, some of which are provided for pulling only and others for dual and multiple independent control.

BACKGROUND OF THE INVENTION

The conventional vertical blind system includes a single length elongate track having a series of vertical blind vane carrier supports axially translatable within the track. The carrier supports each support a single vane and have the capability to slide in one direction, compressing the carriers and vanes, and also to enable the vanes to rotate about their vertical axis to control the light entering the room. This conventional system will usually have a pair of rope or chain actuators at the end, with one rope actuator for movement of the supports to a first bunched position where the vertical blind is "open" and to a second distributed position where the vertical blind is closed. The second chain or rope actuator operates a vane angle control rod to cause the vertical blind individual units to pivot, preferably about their center, to admit or deny light to the room.

In larger applications, the supporting tracks can be quite long, and although anchoring the track along its length presents no special problems, the vane carriers can experience friction and stress from too large of an operation. As the vertical blind is closed, severe tension builds in the chain or rope actuator. Further, the actuator for pivotal rotation of the vanes will similarly experience an increase in tension by solely shouldering the stress from the force necessary to rotate all of the vertical blind units.

Conventional vertical blind systems are set up for a single expansive spread across a single panel. The vertical panels and their carriers are set for a spaced relationship, but forming closure depends upon each of the spacing members allowing each of the vertical units to reach their exact spacing. At the end of the closure travel, any spacing member which has not enabled a full spaced relationship can hold the end carrier back. Since the blinds are usually high up and operated by wand, the user does not have high positive mechanical advantage which would always allow a good closing force.

Even where the force can be applied, the end carrier may not remain at its terminal position and may move away from full closure. This characteristic makes vertical blinds less than an optimum choice for audio visual rooms where the outside light needs to be completely blocked out. One technique involves the provision of up to a 0.5 inch overlap as a sum of overlap with respect to all of the carriers so that there will be adequate coverage. As the overlap increases, even a full closure can result in a noticeable uneven spacing of the individual vertical blind units.

Even where no sticking occurs, the user can bounce the end carrier against the end of the rail causing it to bounce back. Even at best, the user is required to "fuss" with the vertical blind unit to get it to close completely.

These problems just mentioned are bad enough for single panels having a single one directional coverage, and illustrate why workable two direction coverage is practically impossible. Two direction coverage, where the blinds close toward each other at the center of a panel, would require that the two end carriers meet and remain together. The problems are exacerbated where the bringing of one carrier to another would result in the second carrier being bumped away. The user would have to manipulate two control wands together placing a bending force on them. The two carriers, even if brought together would be urged apart by the swinging vertical blind units which are suspended from them.

For longer window spaces, conventional vertical blinds are provided in shorter sections. Conventional vertical blind sets are provided as a series of short sections which all close in one direction. A long run of single extrusion has not been possible for several reasons, including: (1) the rotation rod would sag, and (2) specialized end plate structures would be necessary to end closure by one lead carrier and to start another section. A longer single run would be desirable where the user could change configurations more easily.

Vertical blinds are popular due to the increased flexibility in control they offer over drapes, which have a single control to open or closed. However, in some instances, it would be desirable to subdivide a vertical blind over a long track run to enable selected portions of the extent of the run to be independently opened and closed, and the vanes in each section to be independently actuated to an open or closed position.

This presents a problem for the rope or chain control. If multiple controls are provided at the end of a track, the cross sectional area of demand for control structures increases and the newer tracks of smaller cross sectional area would be unable to handle the structural demands of multiple controls at the end. In addition, such "remote" control of a far section would include the increased tension and stress which is sought to be avoided in a long vertical blind run.

If the elongate run of vertical blind were simply replaced by several short runs of tracking and controls, several sets of rope and chain controls would extend down along the extended run. This would detract from the aesthetic of the window covering arrangement, and the space between any two short runs would be punctuated by a dangling rope and chain control. Even where the rope and chain control were located at opposite ends, there would be a problem in handling its resting position. If the resting position was on the side of the vertical blinds facing the room, the aesthetic would be ruined as the rope would be exposed. If the resting position was on the side of the vertical blinds facing the window and hidden from the room, a user would have to guess the location, plunging his hands into the vertical spaces between the vertical blinds multiple times to try to find the controls, more "fuss". This would cause frustration and probably some destruction of the vertical blinds where users cannot locate the controls quickly.

In addition, rope and chain controls are being increasingly criticized for their danger to small children. Small children have been known to accidentally hang themselves in the downwardly looping rope and chain controls. Thus, the less rope and chain actuators present, the better for safety. Change their supports at support and track systems for vertical blinds and roller shades have concentrated on two problems with two different structures.

One solution has been to provide a tensioning device at the base of the control to discourage slightly the ability of the child to become entangled with the chain or rope control. These "hold downs" staked at intervals along an extended run would certainly ruin the aesthetic when the blinds were open.

Other vertical blind sets use a single wand control. In this configuration, the lead carrier is fitted with a wand which will be manually grasped to pull the lead carrier to an open position or to a closed position. In addition the wand is linked to the lead carrier such that it is rotated to actuate gears in the lead carrier to turn a control rod to thus actuate all of the carriers to cause individual vertical blind vanes to pivot about their vertical axes.

The single wand control has been used with success on single run vertical blind systems. But the single wand control experiences significant tension and wear, especially where the vertical blind extends over a long length. Usually the wand is connected to the lead carrier with a semi-universal double hook link, and thus either pulling actuation or turning actuation might be accomplished at a high stress position.

In a single wand pull vertical blind system, some accommodation needed to be made for providing complete window closure. This has been typically done by providing several inches, up to about a foot of additional vertical blind tracking and system length beyond the end of the vertical blind run, and providing the wall will enable such additional run due to wall space considerations. This is especially needed where the vertical blind system will stick in places over time and where the user has difficulty in getting the vertical blind system to close completely, or where the system can be brought to a complete close, but rolls open slightly when manually released.

In the single length of vertical blind, lacking independent control, a user on one end would have to walk the length of the system in order to adjust the full length of the system. If the vane control happened not to be nearby, the user has to hunt for it. It would be desirable for a user to be able to actuate a singly controlled vertical blind unit from either end.

Another problem in multi-section vertical blinds is the division of control. Aside from the problem of having a single control rod sagging within the extrusion, the single control rod prevents independent vane control over sections of the vertical blind. Independent control would require even more support where the control rods must begin and terminate at a position other than the ends of the extrusion.

What is therefore needed is a manner of forming positive closure in order that vertical blinds may be closed securely, exactly and precisely with regularity. The closure mechanism should be highly integratable with existing track systems and vertical blind carriers. The system should provide for a distributed system of support which will support any tendency of the rotation rod to sag. The system should provide positive feedback to the operator that the blinds are securely closed. The needed system will provide center opening closure which is positive and which consistently and with assurance seals out light from coming in between the closure points. The needed system would provide adequate closure between adjacent multiple sections of a long vertical blind run, regardless of whether the closing carrier were closing against another lead carrier, or against an end carrier.

The needed system should also provide additional control options, including independent vane angle control over sections of the vertical blind system, as well as multiple controls for the minimum size of controlled section, regardless of whether the minimum size of controlled section is the entire run of vertical blind or an individual section within the complete run. A run generally refers to a single length of extrusion, possibly having a pair of end caps.

SUMMARY OF THE INVENTION

The improved system utilizes a series of structures which facilitate either or both independent control and multiple control of a vertical blind system, and including multiple control zones in a single run of vertical blind extrusion. This is facilitated by providing internal support for a single control rod and especially multiple internal supports for multiple internal control rods.

A multiple wand control is provided for both multiple and single control over a given controlled section. To insure full closure of sections within a single run of vertical blind extrusion, a magnetic closure is used along with a mounting structure which provides support for the horizontal control rod. As such, when closure is effected along the length of a vertical blind run, regardless of whether between a pair of sections closing together or one section closing onto the non-moving end of another section, positive closure will be had which affirmatively shuts out light from between the closed structures.

The magnetic support structures which provide this positive closure include members which ride in the carrier, as well as special size members which mount in the lead or wand carrier, as well as other magnetic structures which reside in the vertical blind track end caps. All of the structures of the invention are installable as original equipment or as retro-fit and which can work with existing tracks, carriers and end caps, even though these structures have been optimized for small size. The system of the invention provides for multiple independent control of controllable sections within a run of extrusion, as well as a non-vane actuation wand which is used where only single control is desired over a section of vertical blind.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
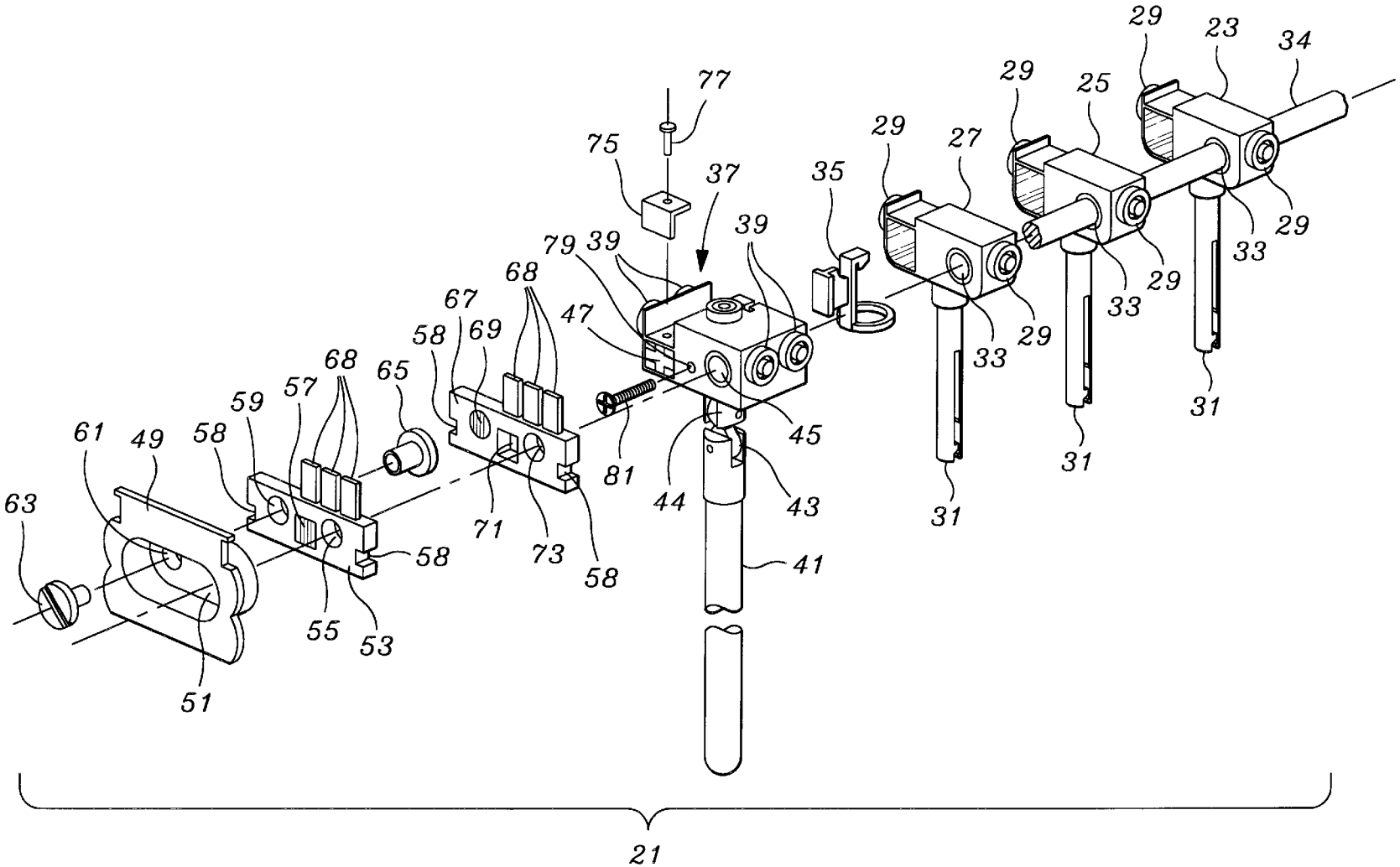
FIG. 1 is a distributed perspective view of the components of a first system using a pair of flat members and shown in a single direction opening format, with respect to the end of a direction of travel for a track system.

The description and operation of the invention will be best described with reference to a prior art configuration which shown in FIG. 1. FIG. 1 is perspective partially exploded, distributed view illustrating a system 21 made up of structures which would normally be supported by a track or rail unit (not shown) which is the structure which is mounted to a ceiling or side surfaces of a window. Beginning at the far right a series of three follower carriers 23, 25 and 27 are seen. Each of the follower carriers 23, 25, & 27 have a pair of rolling wheels 29 which would ride on an internal raceway within the track (not shown). Each of the follower carriers 23, 25, & 27 have a downwardly extending rotatable blind support 31 which vertically supports and rotatably actuates vertical blinds (not shown) attached thereto, in the horizontal plane.

Each of the follower carriers 23, 25, & 27 have a gear structure which operates from an internal rotatable sleeve 33, partially seen in FIG. 1. The internal rotatable sleeves 33 are engaged by a rotatable rod 34 which extends through all of the rotatable sleeves 33 and along which all of the follower carriers 23, 25, & 27 can slidably translate from a closed position where all of the follower carriers 23, 25, & 27 are grouped to the side and an open position where all of the follower carriers 23, 25, & 27 are fully extended with maximum spacing between them. Only a small section of the rotatable rod 34 is shown. Although only three follower carriers 23, 25, & 27 are shown, most applications will have between 15 to 30. Also shown is a connector link 35 which connects the closest follower carrier 27 to closely follow and move with a lead carrier 37. It has a slot portion which engages the lead carrier 37 and a ring portion which engages the downwardly extending rotatable blind support 31. Not shown are the spacing links extending between individual follower carriers 23, 25, & 27 which enable an exact spacing to be set, yet which enable the follower carriers 23, 25, & 27 to move to a compressed position immediately adjacent each other.

To the left of the follower carriers 23, 25, & 27 the lead carrier 37 has two pairs of wheels 39 on each side of the lead carrier 37 which provides for greater stability. A wand 41 is connected to the lead carrier 37 through a fitting 43 to allow a turning of the wand 41, even though oriented at a non vertical angle, to transmit turning forces to the lead carrier 37. The fitting 43 is attached to a turning rod 44. Turning forces from the wand 41 translate into a turning force through the fitting 43 and turning rod 44 to an internal fitting 45 to turn the rotatable rod (not shown) which extends through all of the rotatable sleeves 33, to thus actuate each of the follower carriers 23, 25, & 27.

Conventional lead carriers 37 have a number of physical features. First, they usually have a split housing which has a set of locking fingers (not seen) within a locking finger bore 47. The locking fingers (not seen) have a configuration as a meeting pair of prong shaped members which approach each other at a right angled difference in rotational orientation and lock together producing a cross or "+" shaped locking finger bore 47 which extends completely through the lead carrier 37.

Referring to the far left of FIG. 1, a conventional end cap 49 has an oval depression 51. The end cap 49 is typically injection molded as a single piece of plastic. The materials and structures thus far described are present in most conventional carriers. The other structures seen in FIG. 1 and which are about to be described enable the system 31 to form a positive closure.

Adjacent the end cap 49 is a first, flat member 53 which is intended to fit closely to end cap 49. First flat member 53 has a first bore 55 to accommodate the rotatable rod (not shown). At the center of the flat member 53, is a magnet 57 which extends through the flat member 53 to the other side. The flat member 53 has a pair of slide slots 58 which will engage the tip ends of the raceways (not shown) of the track (also not shown) to help the first flat member with its support. Flat member 53 has a second bore 59. An aperture 61 exists in the end cap 49 to permit a threaded rivet set, including a male rivet member 63 and a female rivet member 65 to extend through the aperture 61, and second bore 59 in order to affix the first member 53 closely adjacent the end cap 49.

Adjacent flat member 53 is a second flat member 67, which has structure to accommodate flat member 53, as will be shown. Second flat member 67 is shown with a series of upward projections 68 and is intended to travel along with the motion of the lead carrier 37 at least partially along the track (shown later). The upward projections 68 are shown as 3, but may be more. Each can be broken off to enable a space to exist between the upper part of the projection 68 and the top of the track (shown later). Screws inserted in the track at various positions lateral to the track will stop a second flat member 67 having an upward projection 68 meeting it to separate it from its magnetic attraction with the lead carrier 37. With three upward projections 68, a series of three screws can be used to spatially disperse three such flat members 67 along a vertical blind system as the lead carrier 67 is moved to open and move back the vane members.

For each second flat member 67 left behind, the engagement of the side slots 58 with the race of the extrusion or track and the engagement of the through bore 73 with the rotatable rod 34 contributes to the support for rotatable rod 34.

A series of traveling second flat members 67 may be provided, each having a magnet 69 for mutual attachment. The magnet 69 extends through to the second side and thus several identical second flat members 67 can be used. Second flat member 67 also has a central rectangular bore 71 and a through bore 73 to accommodate the rotatable rod (not shown). Unlike the first bore 55 of the flat member 53, the through bore 73 must be able to slide freely along the rotatable rod (not shown).

To the right of the second flat member 67, a metal plate 75 has an "L" shape and is attachable to the lead carrier 37 at the bottom horizontal portion of the "L" with a rivet 77. The vertical portion of the "L" shape of the metal plate 75 covers the locking finger bore 47. To the right of the locking finger bore 47 is a screw accommodation bore 79, which is provided to fit an elongate screw 81.

As can be seen, the structures must be compact to enable full closure of the lead carrier 37. All of the metal portions recited are ferromagnetic and thus with the magnetic portions help concentrate and transmit lines of magnetic flux. These structures, including magnets 57 & 69, include male rivet member 63, female rivet member 65, metal plate 75, and an elongate screw 81. The resulting structure is preferably formed with a magnetic polarity creating an oval flux. For example, assuming the end of magnet 69 facing the viewer is North, this polarity is transmitted through the female rivet member 65, male rivet member 63, the lines of flux traveling through air and re-entering the end of magnet 57 having a south polarity. The north pole of magnet 57 would connect with the end of the elongate screw 81, the lines of flux then traveling through the air to the plate 75 and then to the south pole of the magnet 69. This provides some holding synergy even though the structure is limited by two somewhat flat axial length magnets 57 and 69.

The operation of the system 21 will involve the manual actuation by the wand 41 of the lead carrier 37 close enough to the end cap 49 to enable the magnets 57 and 69 to magnetically attach to the adjacent metal members including male rivet member 63, female rivet member 65, metal plate 75, and an elongate screw 81. The clicking into place of the lead carrier 37 against the end cap 49 will provide positive reinforcement to the user, letting the user know that the system 21 has traveled to the closed position to its maximum extent.

Figure 2:
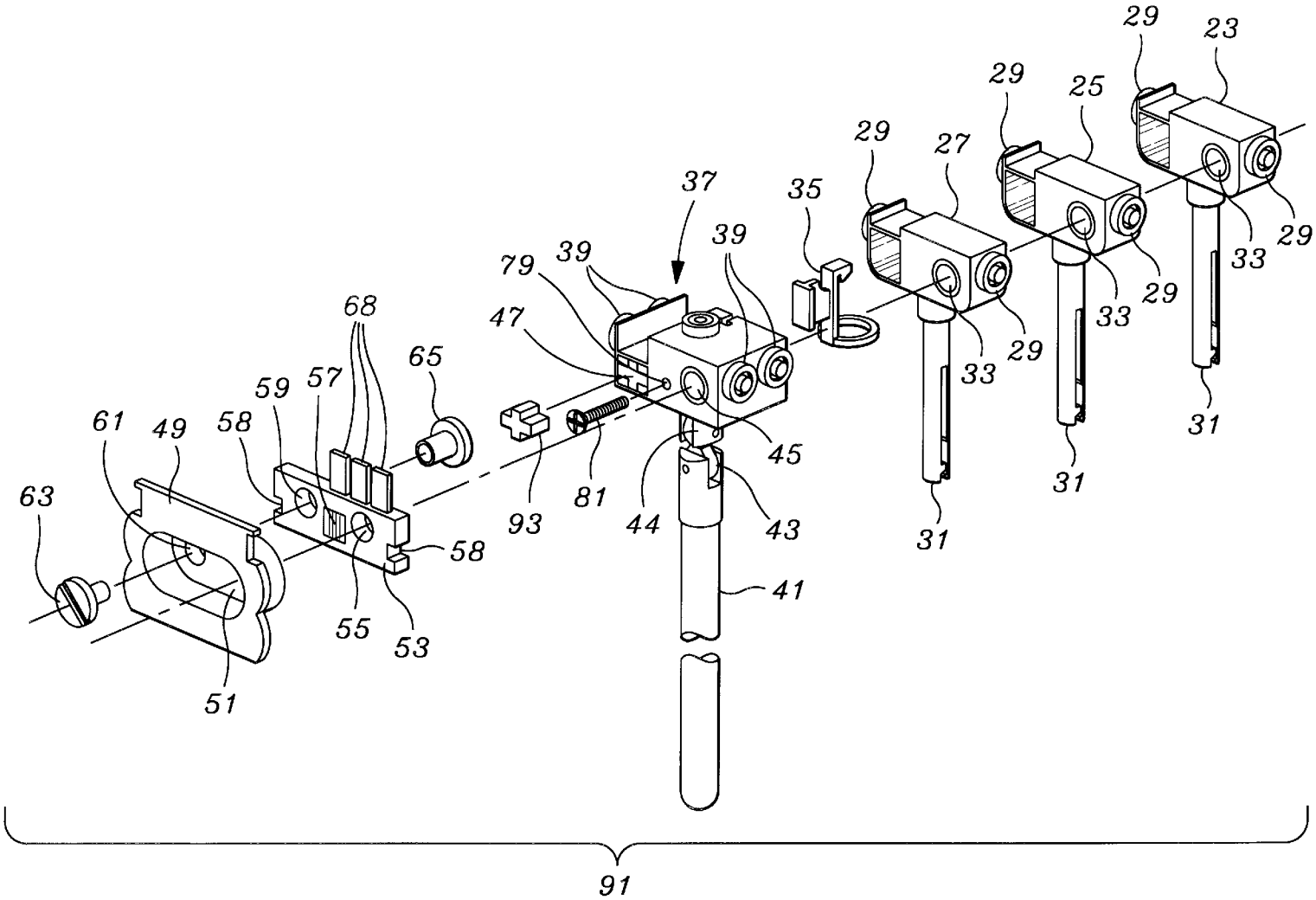
FIG. 2 is a distributed perspective view of the components of a second system using an end rivet securing a single flat member, working in conjunction with a magnet fitted within the lead carrier, and shown in a single direction opening format, with respect to the end of a direction of travel for a track system.

Referring to FIG. 2, a second configuration of a system 91 which is numbered the same as FIG. 1 with the exception that the second flat member 67, metal plate 75, and rivet 77 are not present. In addition, a magnet 93 having a cross "+" shaped cross sectional shape is in position to be inserted within the locking finger bore 47. In this configuration, if the end of magnet 93 facing the observer has a North polarity, the lines of magnetic flux will pass through (as the magnet 93 touches) the female rivet member 65, male rivet member 63. The lines of flux then travel through air and re-entering the end of magnet 57 having a south polarity. The north pole of magnet 57 would connect with the end of the elongate screw 81 (which need not be as long since the second flat member 67 is not present), the lines of flux then traveling through space through the lead carrier 37 and then to the south pole of the magnet 93.

Figure 3:
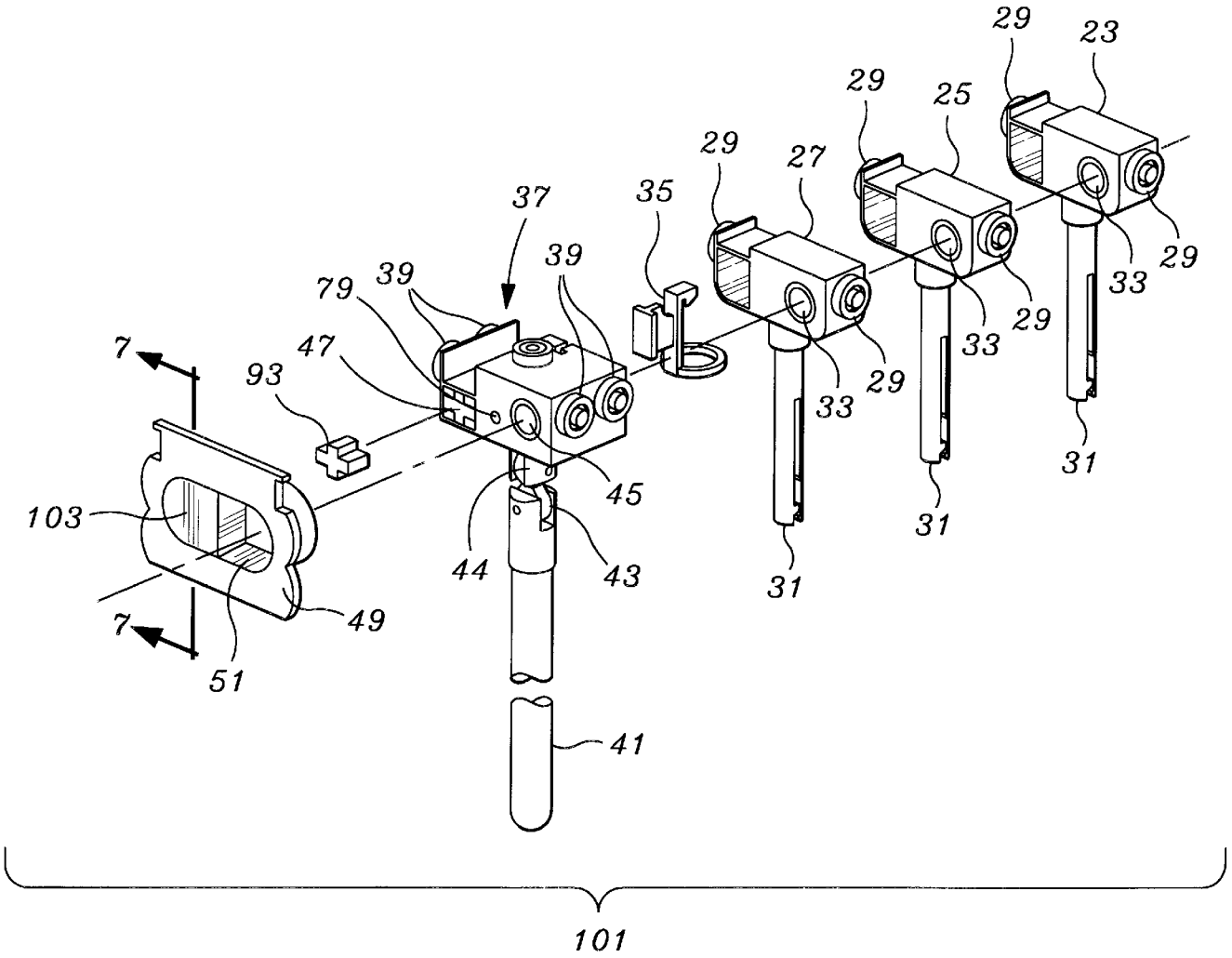
FIG. 3 is a distributed perspective view of the components of a third system using a "D" shaped magnet carried in an end cap and working in conjunction with a magnet fitted within the lead carrier, and shown in a single direction opening format, with respect to the end of a direction of travel for a track system.

Referring to FIG. 3, a third configuration of a system 101 which is numbered the same as FIG. 2 with the exception that the male rivet member 63, female rivet member 65, and first flat member 55 is not present.

The oval depression 51 of the conventional end cap 49 now supports a "D" shaped magnet 103 which occupies about half of the area within the oval depression 51. Since the material of the oval depression 51 is thin, an aperture similar to the aperture 61 will probably not be necessary. If an aperture were necessary, it should be formed so as to prevent magnet 103 from passing through such an aperture, but at the same time making sure that enough of the surface area of the magnet 103 is available for contact with the exposed end surface of magnet 93. This will give a more positive "click" when the lead carrier 37 is brought securely against the end cap 49. This configuration has no concern for a double looping path for lines of magnetic flux since only two magnets are used, but in this case the magnets 103 and 93 are brought into direct contact which will result in a much more secure and powerful holding connection. The magnet 103 may also be press-fit and possibly glued within the oval depression 51.

Figure 4:
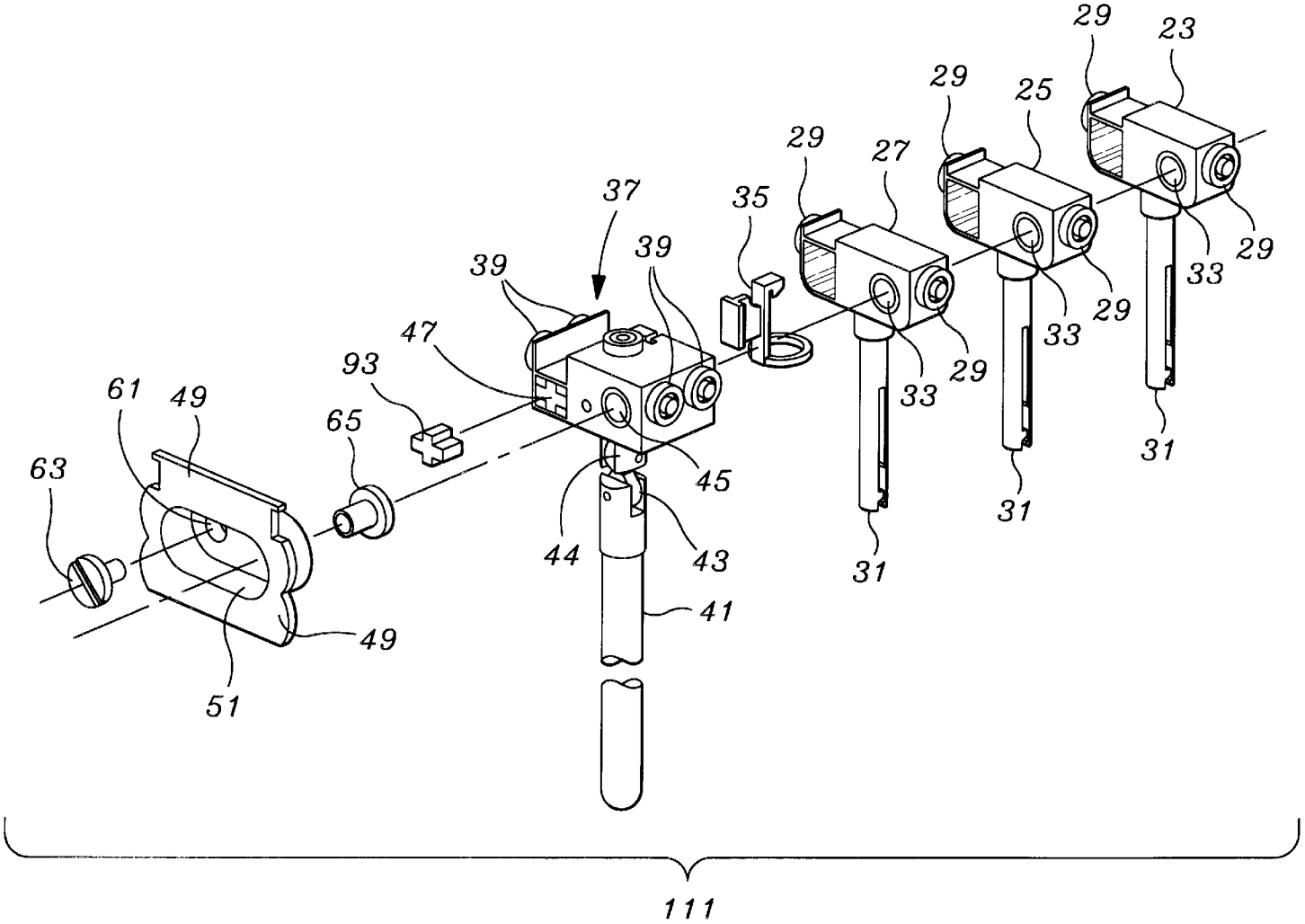
FIG. 4 is a distributed perspective view of the components of a fourth system using a rivet secured to an end cap and working in conjunction with a magnet fitted within the lead carrier, and shown in a single direction opening format, with respect to the end of a direction of travel for a track system.

Referring to FIG. 4, a fourth configuration of a system 111 which is numbered the same as FIG. 3 with the exception that the male rivet member 63, female rivet member 65, are re-introduced in place of the magnet 103 with the magnetic connection between the magnet 93 and rivet members 63 and 65 forming the sole magnetic holding connection. The iron content of the rivet members 63 and 65 have to be high enough to enable the magnet 93 to hold the lead carrier 37 against the end cap 49.

Figure 5:
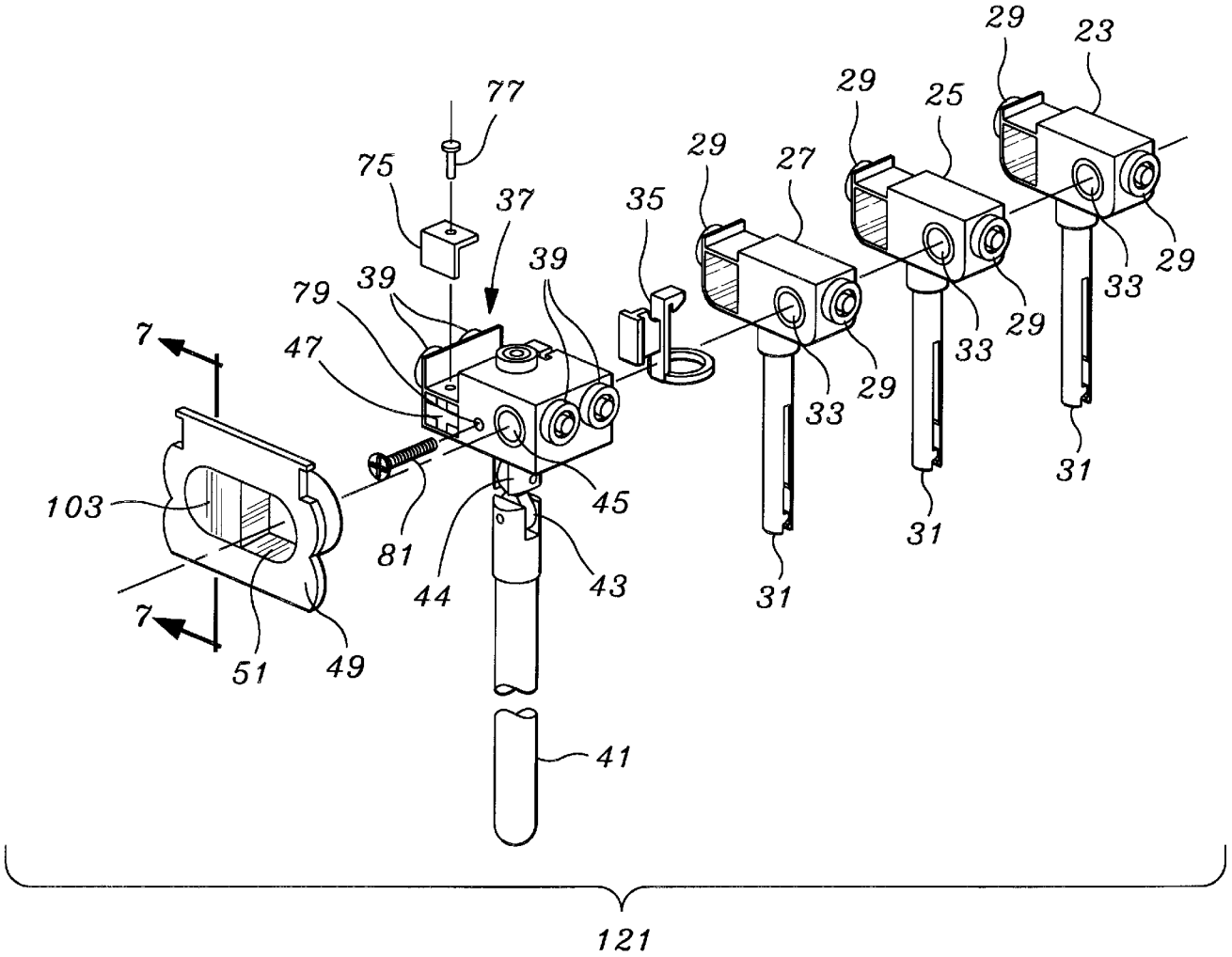
FIG. 5 is a distributed perspective view of the components of a fifth system using a "D" shaped magnet carried in an end cap and working in conjunction with a plate mounted upon the lead carrier, and shown in a single direction opening format, with respect to the end of a direction of travel for a track system.

Referring to FIG. 5, a fifth configuration of a system 121 is a combination of the end cap 49 and magnet 103 of FIG. 3, along with the right portion of FIG. 1 beginning with the metal plate 75. All numbering of the structures are equivalent. In operation, the system of FIG. 5 provides magnetic, and preferably touching contact between the magnet 103 and the metal plate 75.

Figure 6:
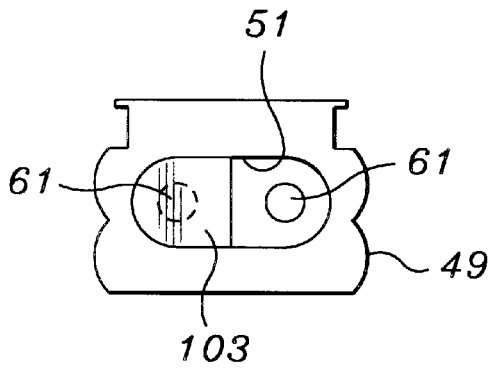
FIG. 6 is an end view of the end cap seen in FIGS. 1–5.
Figure 7:
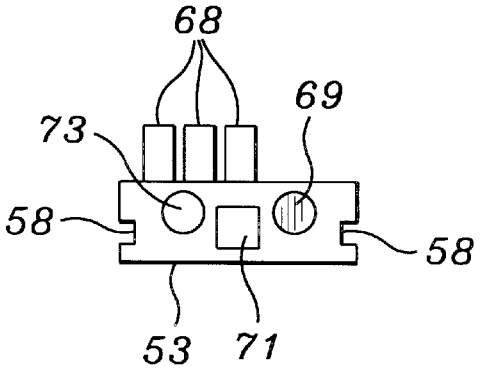
FIG. 7 is a plan view of a first flat member as seen in FIGS. 1 & 2.

For completeness, FIG. 6 shows an end view of the end cap 49 with the magnet 103 in place. FIG. 7 is a view of the back side of the flat member 53.

Figure 8:
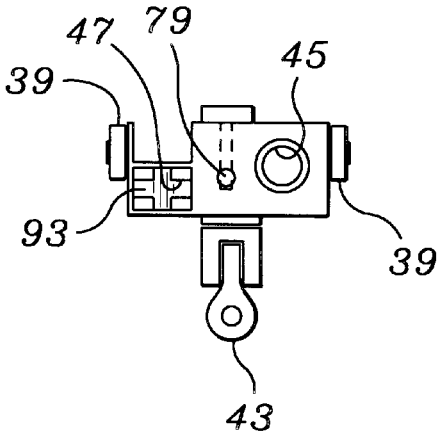
FIG. 8 is a plan view of the lead carrier from a side as seen in FIGS. 1–5.
Figure 9:
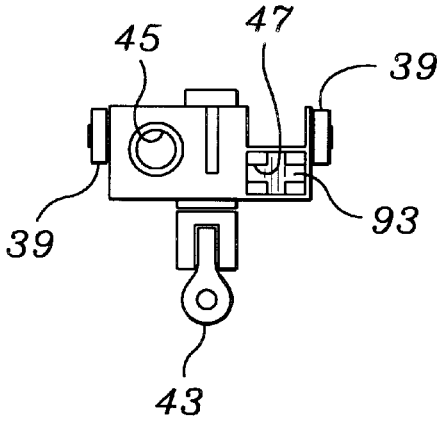
FIG. 9 is a plan view of the other side of the lead carrier as seen in FIGS. 1–5.

FIG. 8 is a view of the lead carrier 37 as also seen in FIG. 3, with the magnet 93 in place within the locking finger bore 47. FIG. 9 is a view of the back side of the lead carrier 37, which is a mirror image of the view of FIG. 8 and which illustrates that the magnet 93 extends completely therethrough. Since the magnet 93 extends completely there through, the lead carrier 37 of FIG. 3 be used with an adjacent carrier 37 to form a carrier—carrier direct magnetic connection, as is shown in FIG. 10.

Figure 10:
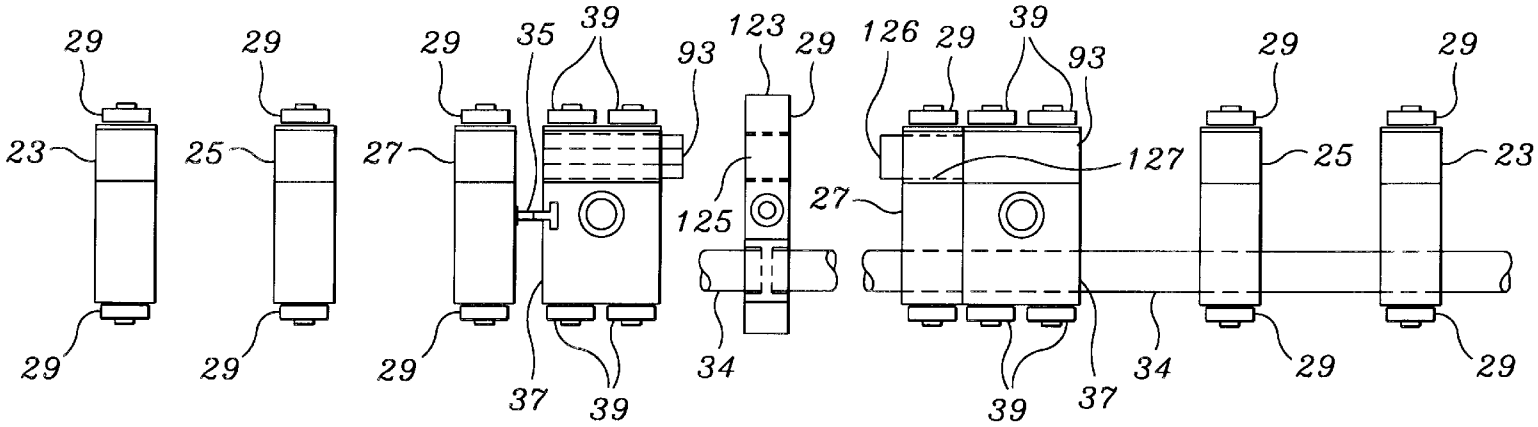
FIG. 10 is a top view of the components cooperating as seen in FIGS. 3 and 4, and shown in a double, opposite direction opening format, with respect to the middle of a pair of opposing directions of travel for a track system.

FIG. 10 is a top view of the members in a middle closure orientation with two lead carriers 37 each having the magnet 93. This configuration is most closely associated with configurations of the lead carrier 37 as seen in FIGS. 2 and 3. The configuration of FIG. 10 further contains a middle fitting 123 which would be attached to the top of the track (to be shown) and would provide a rotating cupped support for the rotatable rods 34 to rotate independently so that one side of the closed vertical blind system 21, 91, 101, 111, or 121 could be operated independently of the other side of the closed vertical blind system 21, 91, 101, 111, or 121. The fitting 123 has an opening or shallow bore 125 to enable magnet 93 to engage a magnet 126 fitted within an aperture 127 in the follower carrier 27. Note that the follower carrier 27 has been moved to the other side of the lead carrier 37 in order to provide vertical blind coverage conveniently to the middle area of meeting of the configuration of FIG. 10.

Figure 11:
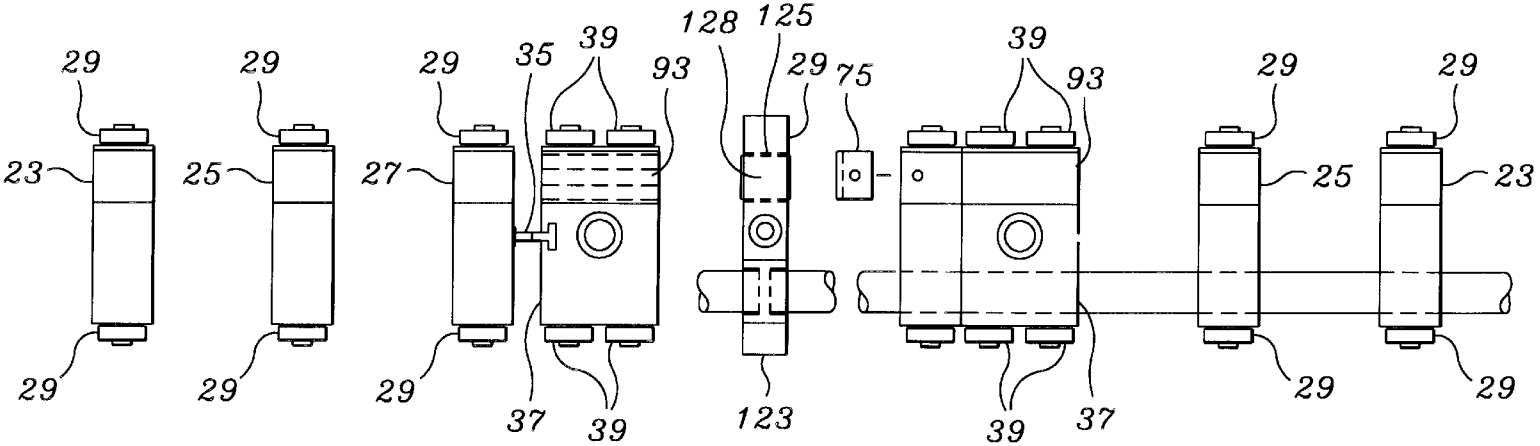
FIG. 11 is a top view of the components cooperating as seen in FIGS. 1 and 3, with one lead carrier having a plate and the other having a magnet and shown in a double, opposite direction opening format.

Alternatively, a carrier 37 as in FIG. 1 with metal plate 75 can be used adjacent a carrier 37 with magnet 93 as was shown in FIG. 3, and this is shown in FIG. 11. The fitting 123 has a magnet 128 within the shallow bore 125 to engage the magnet 93 and a plate 75. FIG. 11 is a top view of the members in a middle closure orientation, with one carrier 37 having a magnet 93 and the other having metal plate 75.

Figure 12:
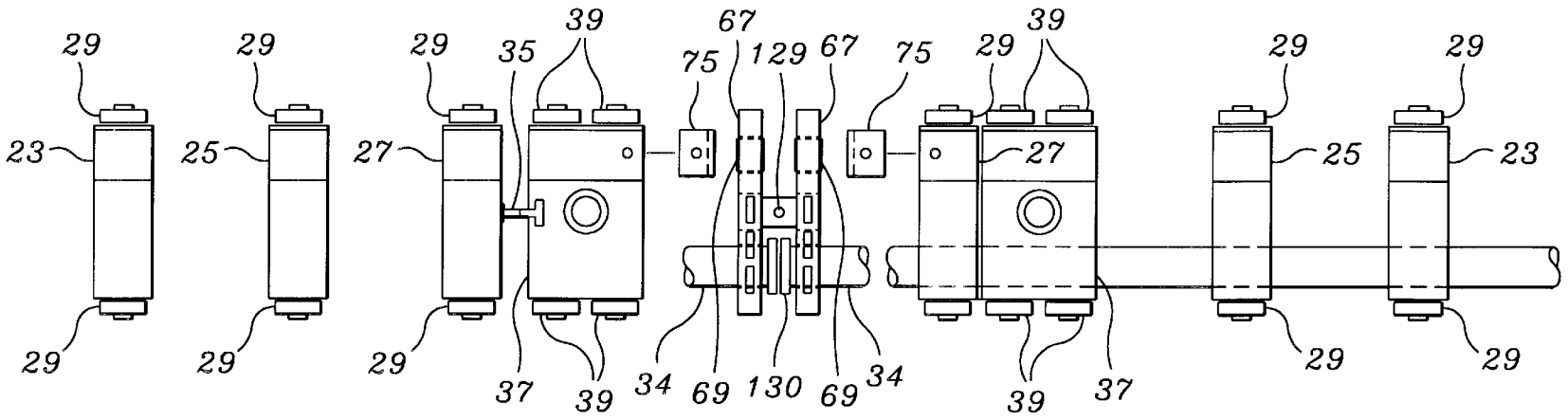
FIG. 12 is a top view of the components cooperating as seen in FIG. 1, with each lead carrier having a plate and two lead carriers working in conjunction with two flat members and shown in a double, opposite direction opening format.

In the alternative, a pair of second flat members 67 can be used together at the center of a track, in conjunction with a pair of lead carriers with metal plates 75 as were shown in FIG. 1. A top view of this configuration is shown in FIG. 12. In this case, the magnets 69 will be oriented North-South North-South, even though separated. A connector 129 is provided to connect the two second flat members 67. The two meeting and independently rotatable rods 34 have an expanded portion 130 which enables the two second flat members 67 to operate as a rotatable support fitting.

Figure 13:
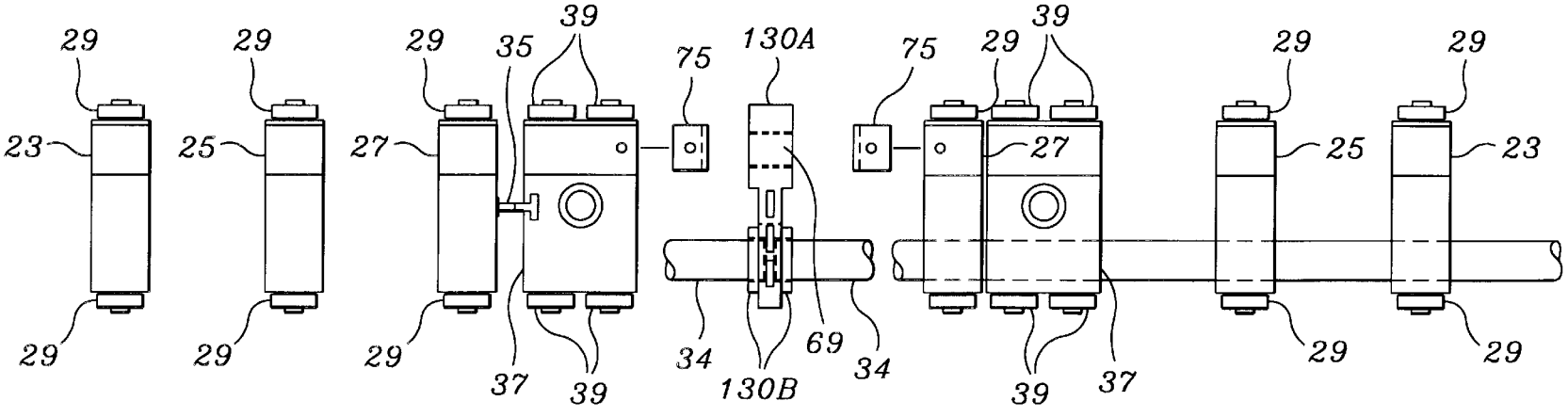
FIG. 13 is a top view of the components cooperating as seen in FIG. 1, with each lead carrier having a plate and two lead carriers working in conjunction with a single flat member and shown in a double, opposite direction opening format.

In the alternative, a single second flat member 67 can be used with a pair of lead carriers 37 as shown in FIG. 1, using a single magnet member at the center to form closure with two carriers 37. A top view of this configuration is shown in FIG. 13. A fitting 130A has a magnet 69 and has a pair of sleeves 130B which assist in holding the two independently rotatable rods 34.

Figure 14:
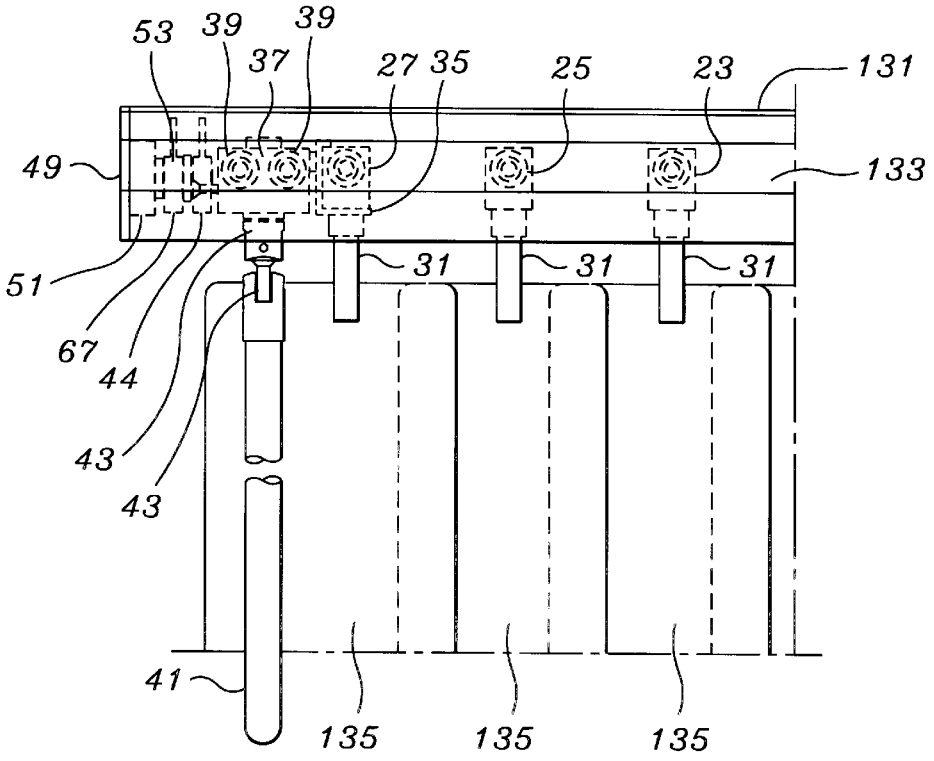
FIG. 14 is a plan view illustrating the invention most closely associated with FIG. 1 in a closed position with a one sided configuration.

The operation of the invention in a one sided configuration will be shown with respect to the configuration of FIG. 1, and it will be shown in FIG. 14. A track 131 is a hollow, inverted "U" shaped channel having a race 133 upon which the wheels 29 and 39 ride. For simplicity, the rotatable rod continues not to be shown. Seen for the first time are vertical blind vanes 135 which are seen to overlap each other as they are shown in the closed position. As is usual, the follower carrier 27 which is most closely adjacent to the lead carrier 37 is attached to move with the lead carrier so that the lead carrier will have coverage behind it of the first vane 135. The vane 135 associated with the follower carrier 27 may be of wider dimension to insure that the window opening in which the track 131 fits has as complete closure as possible.

Figure 15:
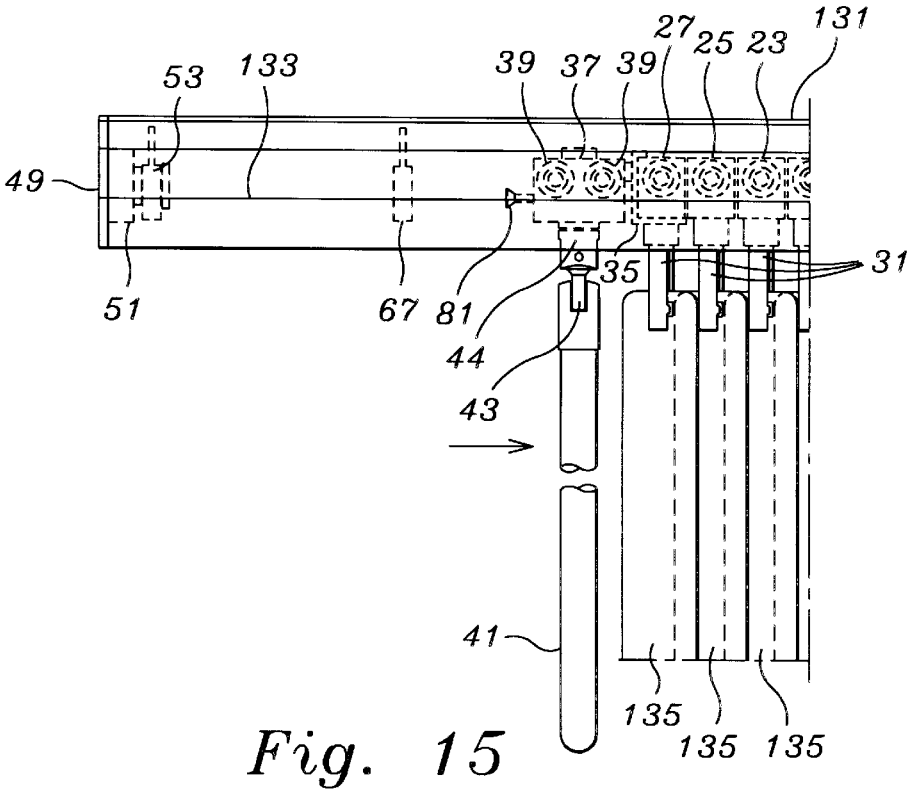
FIG. 15 is a plan view of FIG. 14, but shown in the open position.

Referring to FIG. 15, the configuration of FIG. 14 is shown in the open position. Note that second flat member 67 has been allowed to travel freely and need not be connected firmly to the lead carrier 37.

Figure 16:
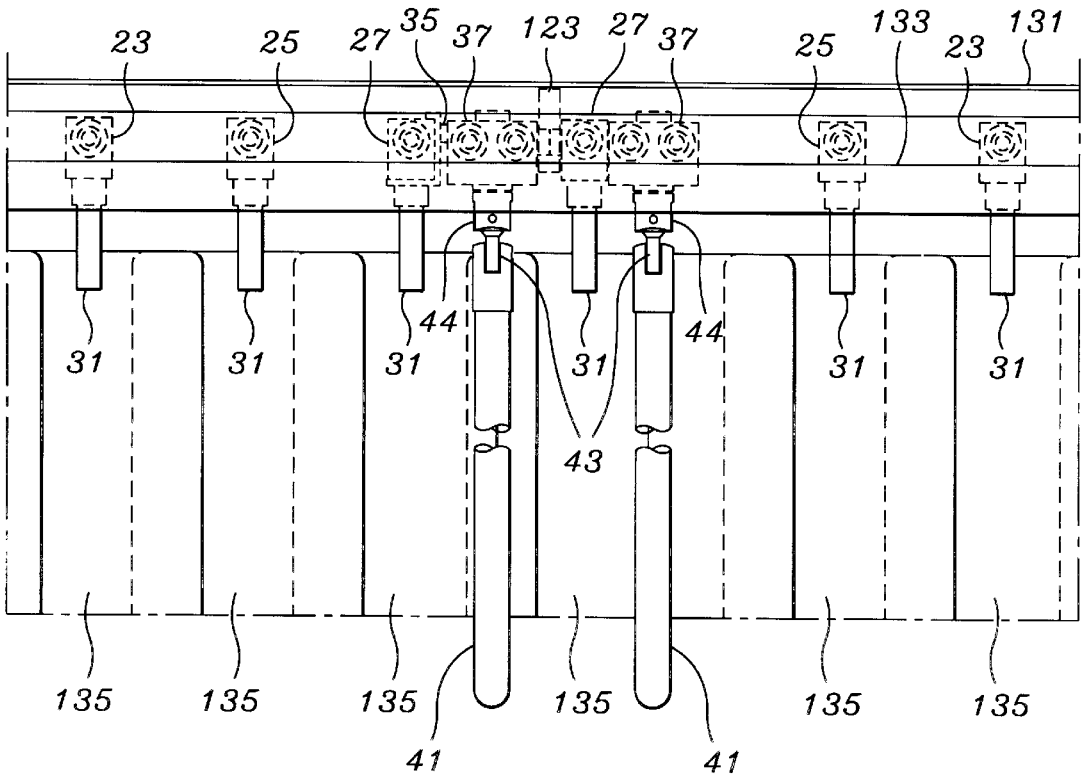
FIG. 16 is a plan view illustrating the invention most closely associated with FIG. 10 in a closed position with a two sided, middle opening and closing configuration.

Referring to FIG. 16, a plan view a two sided configuration in accord with the exploded top view of FIG. 10 is shown. In this configuration, the lead carriers 37 are both fitted with magnets 93. Again, track 131 and its race 133 is present upon which the wheels 29 and 39 ride. For simplicity, the rotatable rod continues not to be shown.

Figure 17:
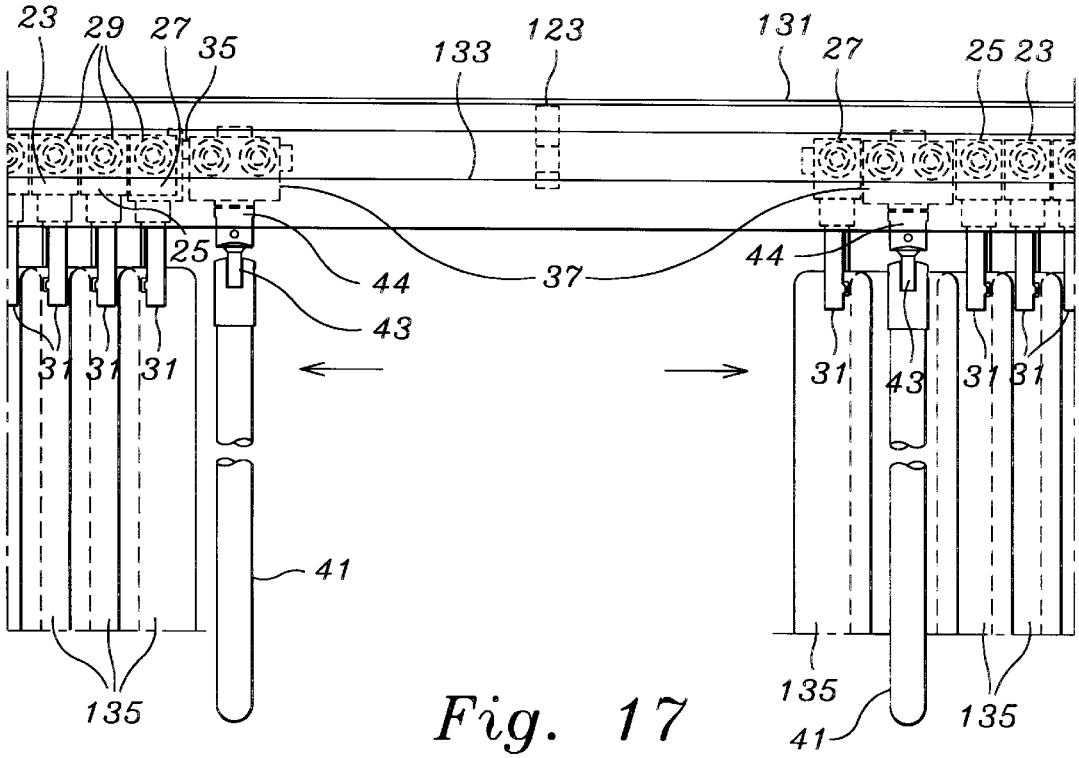
FIG. 17 is a plan view of the middle opening and closing configuration of FIG. 16, but shown in the open position.

Referring to FIG. 17, the configuration of FIG. 16 is shown in the open position. Note that so long as spacing of the follower carriers 23, 25 and 27 and others is proper, no special center marker or stop is needed. Such a center stop could be provided if it was desired to make sure that the additional dimensioning of separation over absolute tolerance was to be distributed evenly.

Figure 18:
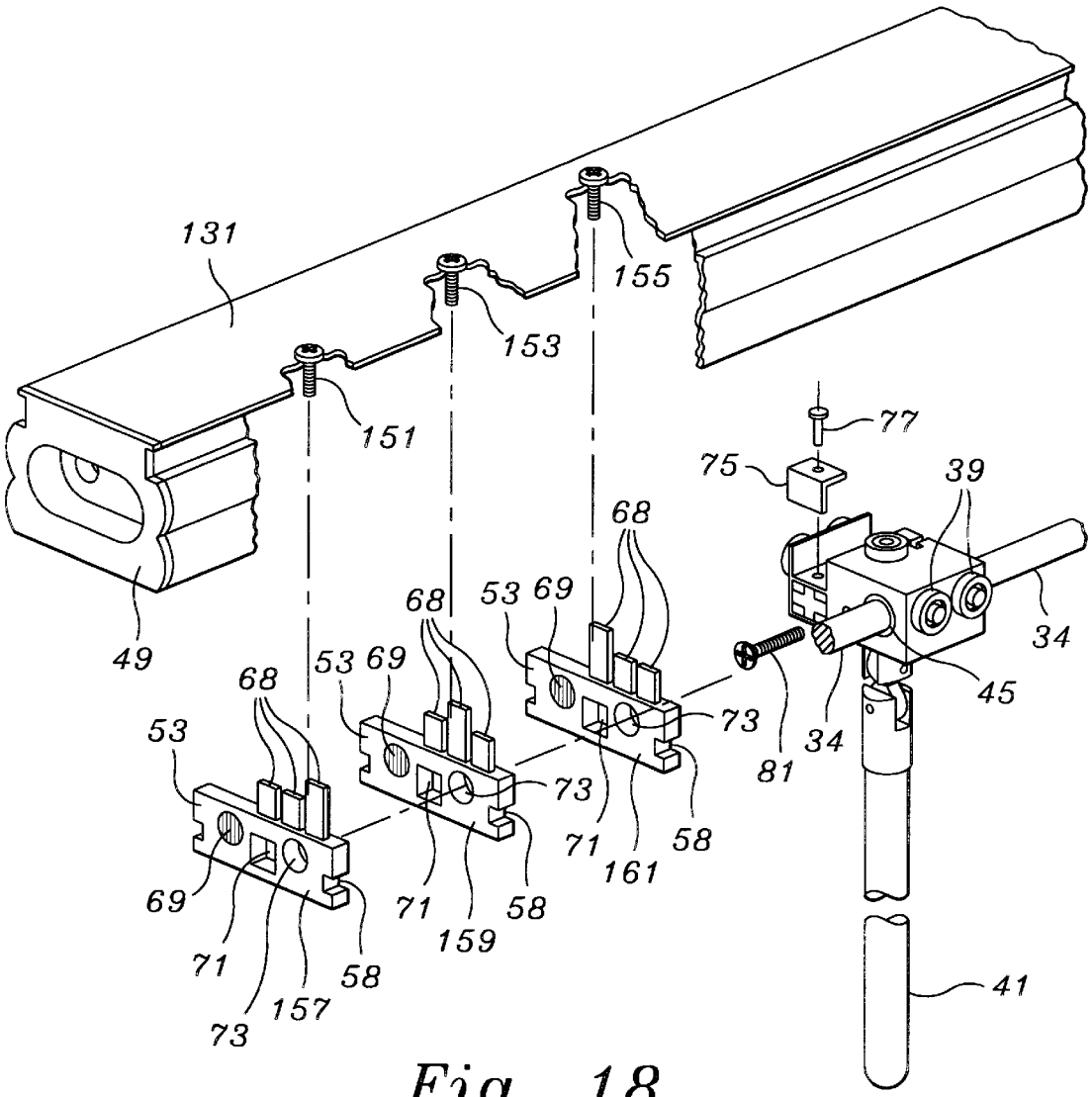
FIG. 18 is a perspective exploded view illustrating the screws in a track which provide a series of stops to spatially distribute a series of second flat members.

FIG. 18 illustrates a drop-down exploded view of the track 131 having a series of three screws 151, 153, & 155 spaced along its length, but at differing positions across the width of the track 131. Below the track 131 is a series of second flat members 157, 159, and 161 which have differing ones of the upper members 68 in the upward-most position. Normally, these three members would be magnetically attracted to each other and lightly held together by the magnets 69, as well as held to the lead carrier 37 via attraction to the plate 75. However, as the lead carrier 37 is moved along the track, the second flat member 157 engages the screw 151 and stays at screw 151. The two second flat members 159 and 161 continue to be moved along behind the lead carrier 37 until the second flat member 158 and its upper portion 68, especially the middle finger, engages screw 153 and is then stopped and separated from second flat member 161, remaining behind to support the rotatable rod 34. Likewise, as the lead carrier 37 and second flat member 161 are moved along, engagement of the upper portion 68 of the second flat member 161 with the screw 155 with the screw 155, the second flat member 161 is left behind to support the rotatable rod 34. When the vertical blinds are to be closed, the lead carrier 37 is moved back to the left, sequentially collecting the second flat members 161, 159, and 157 before it and then spatially compressing these members against the end cap 49 which positively holds the lead carrier 37 in a shut or closed position.

Figure 19:
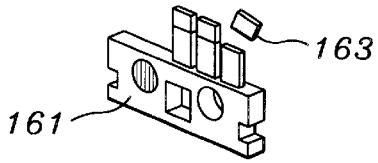
FIG. 19 illustrates a single second flat member in position to be modified by having a rightmost finger of its upper projection removed to leave other fingers free to engage a stop screw.

Referring to FIG. 19, the upper portion 68 of second flat member 161 is modifiable by the installer to have only the left projection extend upward. As shown in FIG. 19, a discard piece 163 is being separated leaving two fingers up. A subsequent separation of the middle finger will leave only the left finger extended upwardly.

Figure 20:
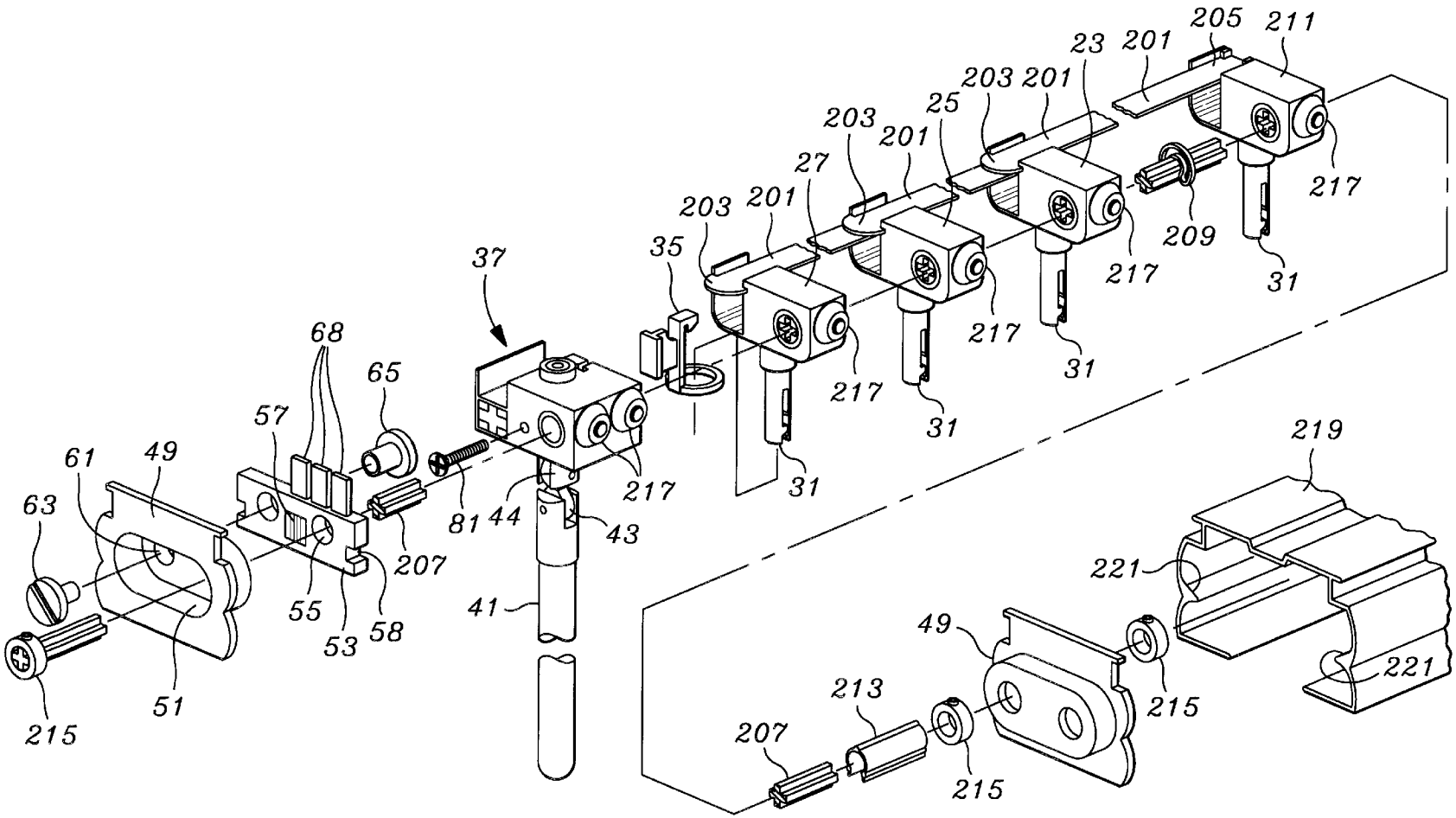
FIG. 20 illustrates a configuration similar to FIGS. 1 and 2 with a single screw, single magnet & support positive close structure, spacers and a locking end ring to hold a cross-sectionally shaped control rod in place with respect to the end caps.

FIG. 20 illustrates a configuration similar to FIGS. 1 and 2 with a single screw, single magnet & support positive close structure, spacers and a locking end ring to hold a cross-sectionally shaped control rod in place with respect to the end caps. Many of the same structures of FIG. 20 are the same as were shown in the earlier Figures and will be mentioned only to illustrate new structures.

A series of slidably displaceable spacer tabs 201 are seen within the carriers 27, 25 & 23. Each spacer tab 201 has a head end portion 203. The lattermost spacer tab 201 has a tail end 205 having a pair of raised portions which hold it in place with respect to any attached head end portion 203. As can be seen, a control rod 207 is cross shaped and extends through the lead carrier 37 and the other carriers 27–23. Adjacent the carrier 23, a portion of the control rod 207 contains a clamp ring 209 which, in a multiple section configuration, serves to hold an end carrier 211 in a position where it is prevented from coming forward. Continuing to the right of the end carrier 211 the control rod 207 may be engaged by an elongate spacer clamp 213 which has a raised rib at its center and flared side rails to provide good bearing force against any rearward sliding movement of the end carrier 211. At the other side of the clamp 213, a cap 49 may be located. On the other end of the cap 49 is located a lock ring 215. A better example of a lock ring 215 is shown at the extreme left side of the FIG. 20. The lock ring 215 has a threaded radially extending bore and a set screw to tightly engage the control rod 207. As will be seen, the end of the control rod 207 need not end at an end cap 49 but can be terminated at points throughout the vertical blind system.

In some systems, the lock ring 215, when it occurs on the outside of an end cap 49, can be replaced with a metal push ring which locks onto the end of the control rod 207. The push ring is usually not used for multiple internal control rod 207 terminations since it does not provide as much ability to be exactly fitted as does the lock ring. In addition, the lock rings 215 have a substantial end surface which facilitates rotation while bearing contact is made with respect to adjacent lock rings 215 on adjacent sections of control rod 207.

In the vertical blind system shown in FIG. 20, the lead carrier 37 and carriers 23, 25, 27, & 211 all have frusto conical wheels 217. The frusto-conical wheels 217 are designed to ride within an extrusion or track 219 having a pair of inclined raceways 221. This provides a self-centering effect and uses the weight force of the vertical blind members to keep them centered within the track 219.

Figure 21:
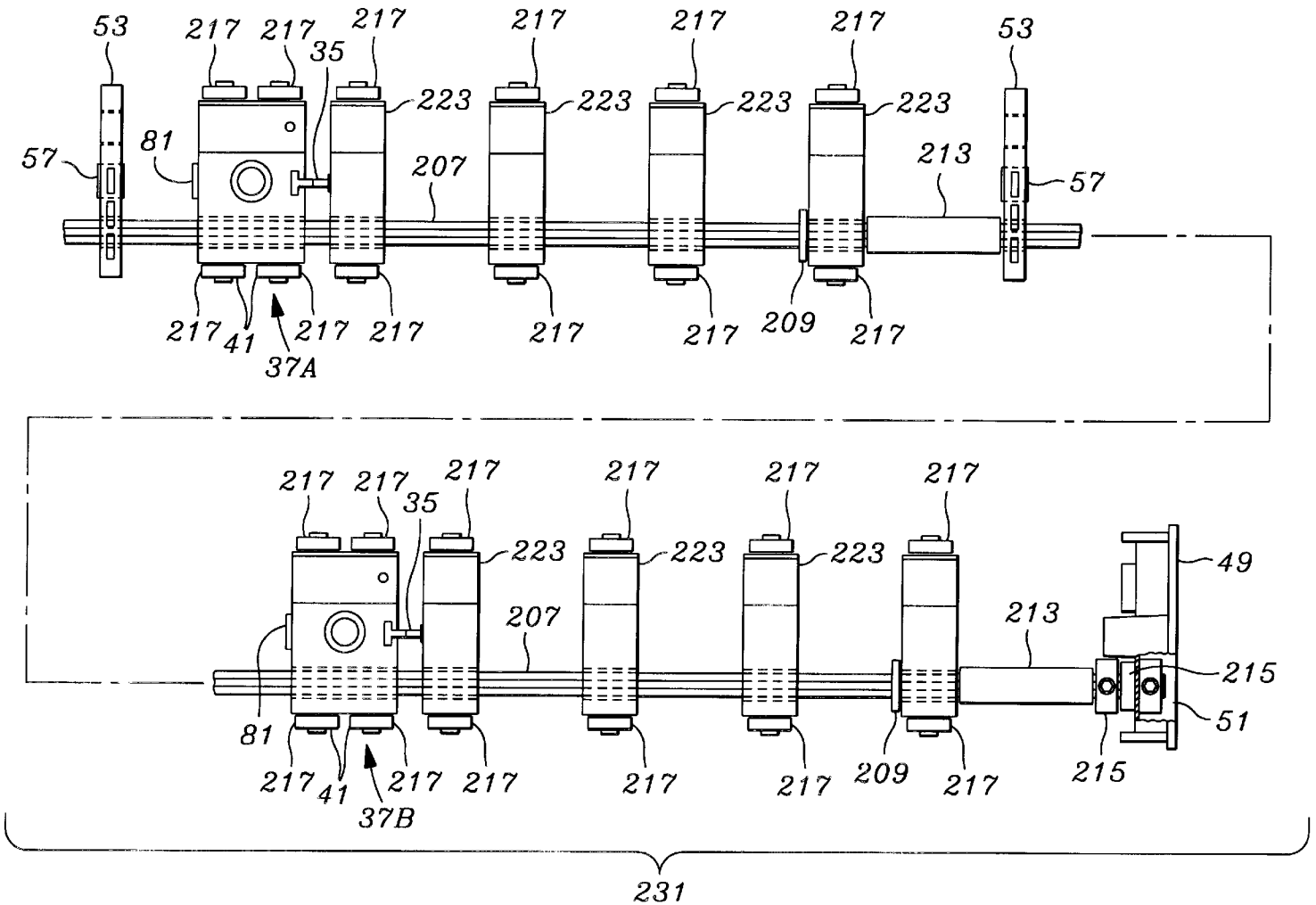
FIG. 21 is a top view of two lead carriers as seen in FIG. 20 but arranged in a side closure positive close orientation, and having single control of the vertical blind section.

The basics for illustrating multiple versions of controlled sections of vertical blinds being given, and referring to FIG. 21, a simplified numbering system will be used to facilitate system description. In addition to the lead carrier 37, all of the following carriers will be referred to simply as carriers 223. The series of slidably displaceable spacer tabs 201 are removed for clarity. A conventional end cap 49 is shown in FIG. 21 for illustration purposes, but may be eliminated from some other views since the configurations shown may repeat within a single run of track 219 and termination of any set or subset of any system does not necessarily have to terminate at an end cap.

FIG. 21 is a top view illustrating a system 231 having two lead carriers 37A and 37B, the lead carriers 37 as seen in FIG. 20, but arranged in a side closure positive close orientation, and having single control of the vertical blind section, but with dual control through the two lead carriers 37. The wands 41 are shown in perspective and angled to the side to emphasize the fact that the lead carriers 37A and 37B have wand controls. Again, these will be omitted from subsequent Figures, but are shown here for clarity. The lead carriers have the letter designation to illustrate the action involved. In this configuration, when the wand 41 of one lead carrier, say lead carrier 37A is actuated, the control rod 207 of FIG. 21 is rotated which causes each carrier 223 to turn its downwardly extending rotatable blind support 31 to turn the individual vertical blind vanes 135. However, because lead carrier 37B has its wand 41 mechanically engaged with the control rod 207, the wand 41 of lead carrier 37B will turn in reaction to the movement of the control rod 207. So long as non-driven wand 41 are free to rotate, the dual control should be had with no problems. Even where 3, 4 or more driven wands are present, the only consideration is whether the internal structures and frictional considerations will permit such multiple controls.

Beginning from the upper left portion of the drawing, a flat member 53 can be supported within the track 219 by attachment, engagement with a member extending within the track or at an end cap 49 as was shown in FIG. 1. The attachment details which exist beyond (to the left with respect to FIG. 21) flat member 53 will depend upon what exists beyond it. For end cap terminations, the male rivet member 63 and female rivet member 65 as seen in FIG. 1 can be used. For single control, a series of spacers can be used. For independent control, where the rotation of control rod 207 is not to extend much beyond flat member 53, a pair of flat members can be combined for additional strength.

The only aspect of the presence of the single flat member 53 shown is the presence of the magnet 57 which provides a positive closure with respect to the ferrous screw 81. Again, another mechanism can be used, but since the following Figures emphasize overall configuration, a consistent positive closure mechanism will be shown to place appropriate emphasis on the configurations and variations between such configurations.

The lead carrier 37A carries frusto-conical wheels 217, and the head of the screw 81 can be seen. Link member 35 can be seen connecting the first lead carrier 37A to the first following carrier, which is one of the carriers 223. The carriers 223 following the lead carrier 37A will be much more numerous than those shown in FIG. 21. Immediately before the last of the carriers 223 is the clamp ring 209. Immediately after the last of the carriers 223 is elongate spacer clamp 213. The clamp ring 209 and the spacer 213 act to keep the last carrier 223 from movement along the track 219. The spacer 213 also keeps the last carrier 223 spaced with respect to the next most adjacent flat member 53. The flat member 53 may be held in place by the track 219 or by a lock washer similar to clamp ring 209, but much thinner, in order to enable the lead carrier 37B to approach the flat member 53. So, lead carrier 37A can move the vertical blind vanes 135 toward the end carrier adjacent the clamp ring 209 in a stacking operation to open the portion of the window or door covered by that portion of the system 231, or oppositely with the lead carrier 37A approaching its magnetic closed position against the left most flat member 53 to close that section of the system 231.

The right portion of the system 231 shown at the bottom of FIG. 21 illustrates lead carrier 37B and its series of following carriers 223. The last carrier 223 to the right of the lead carrier 37B has a clamp ring 209 and on its opposite side, an elongate spacer clamp 213. To keep the last vertical blind vane 135 from bumping the wall (assuming the system 21 is located near a wall) the elongate spacer clamp 213 to the right of the last carrier 223 not only keeps the last carrier 223 from movement, but spaces it from the end cap 49.

To the right of the right most elongate spacer clamp 213, a lock ring 215 is used to provide an expanded surface area with which to bear gently against the flat inner surfaces of the end cap 49, where no other structures are present. Of course, a nylon washer or the like can be interposed between the lock ring 215 and the inside surface of the end cap 49 to reduce friction. In any event, a second lock ring 215 is provided in the space of the oval depression 51 of the outside of the end of the end cap 49, the second lock ring 215 securing the end of the control rod 207 with respect to the end cap 49. As an alternative, the previously mentioned press washer can be used to secure the end of the control rod 207 with respect to the end cap 49. The system 231 thus formed is a two section, side draw, single actuation, dual control vertical blind system.

Figures 22, 23:
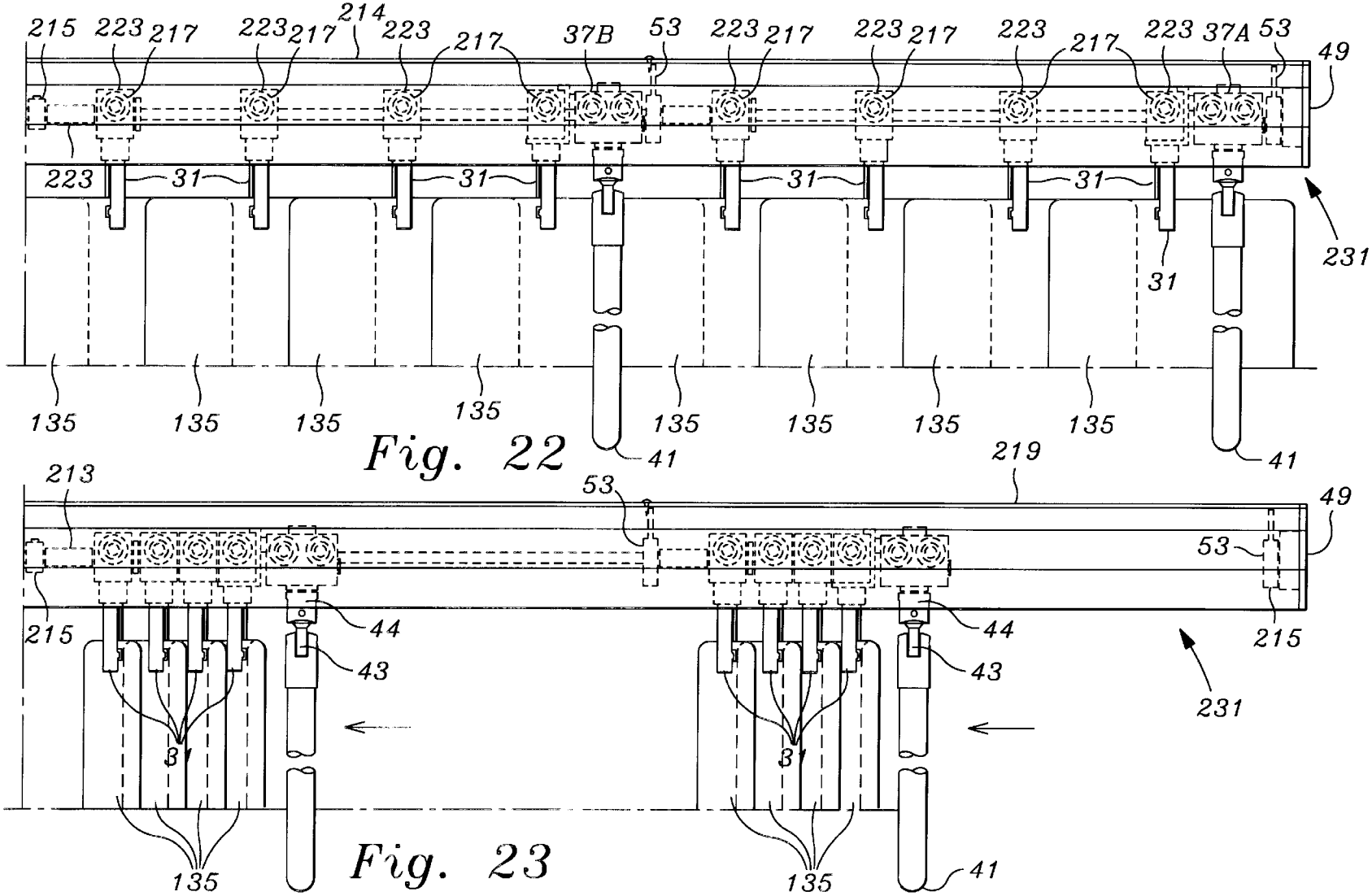
FIG. 22 is a side view of the orientation of FIG. 21 and illustrating a pair of control wands for multiple control access on the single control section shown, and shown in closed position.
FIG. 23 is a side view of the orientation of FIGS. 21 & 22 and illustrating a pair of control wands for multiple control access on the single control section as seen in FIG. 22, and shown in open position.

FIG. 22 is a side view of the orientation of the system 231 of FIG. 21 and illustrating a pair of control wands for multiple control access on the single control section shown in FIG. 21, and is shown in closed position. FIG. 23 is a side view of the system 231 of FIG. 22 and shows the configuration resulting from multiple side opening action.

Figure 24:
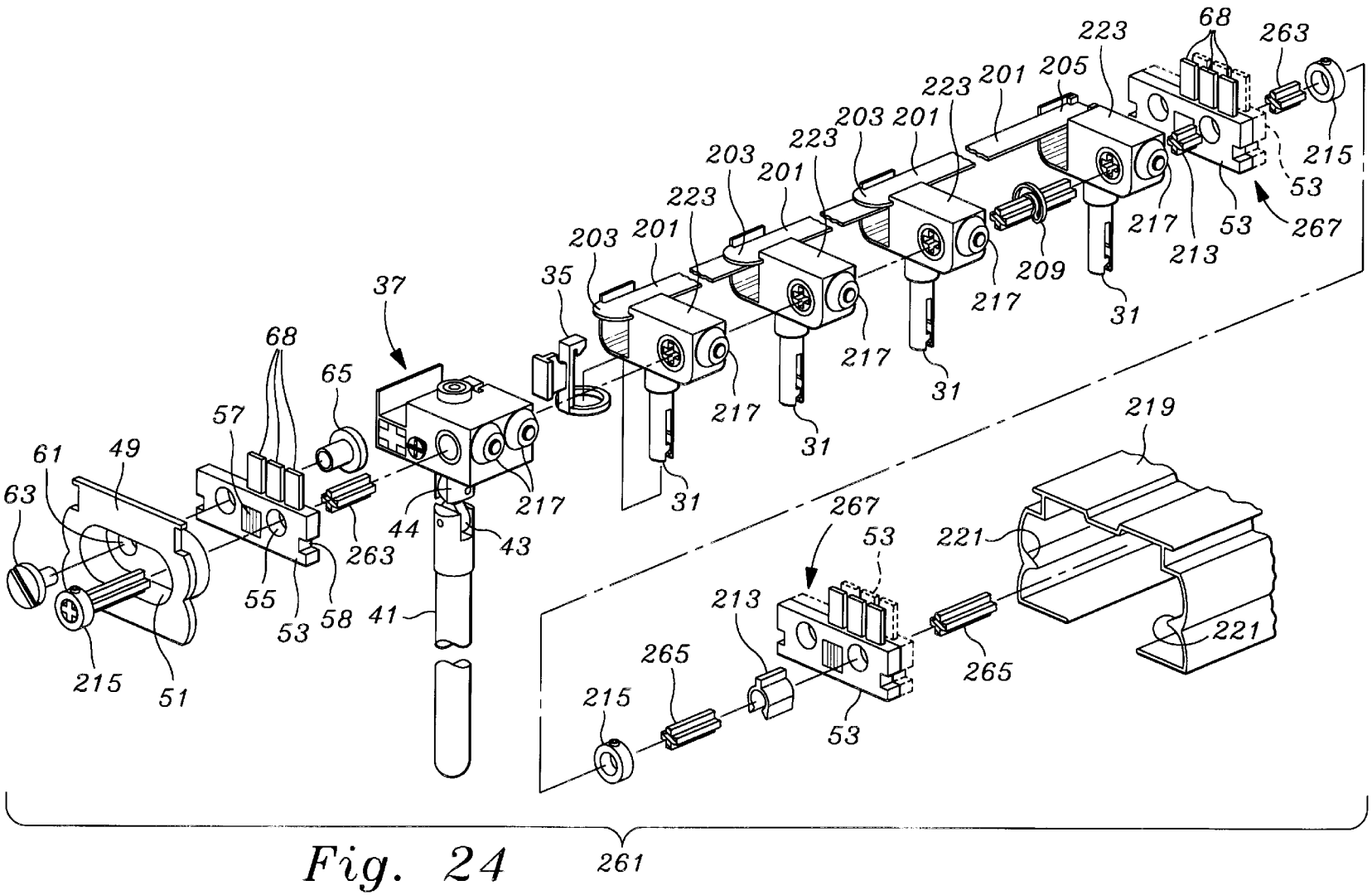
FIG. 24 illustrates an exploded view of a section at which independent control is formed utilizing a pair of supports, spacers and locking rings positioned adjacent a mirror image locking ring spacer and support extending into a second control zone.

Referring to FIG. 24, a system 241 illustrates a three zone vertical blind system having three lead carriers, including lead carriers 243A, 243B, and 243C. In this configuration, because only single control is had, the rotation of any one of the wands 41 of the lead carriers 243A, 243B, and 243C will result in rotation of the other two wands. In such a system it should be insured that all of the lead carriers 243A, 243B, and 243C are freely operable, as the control rod 207 will have to provide the force to not only turn the vanes 135, but also the carriers which passively turn.

Figure 25:
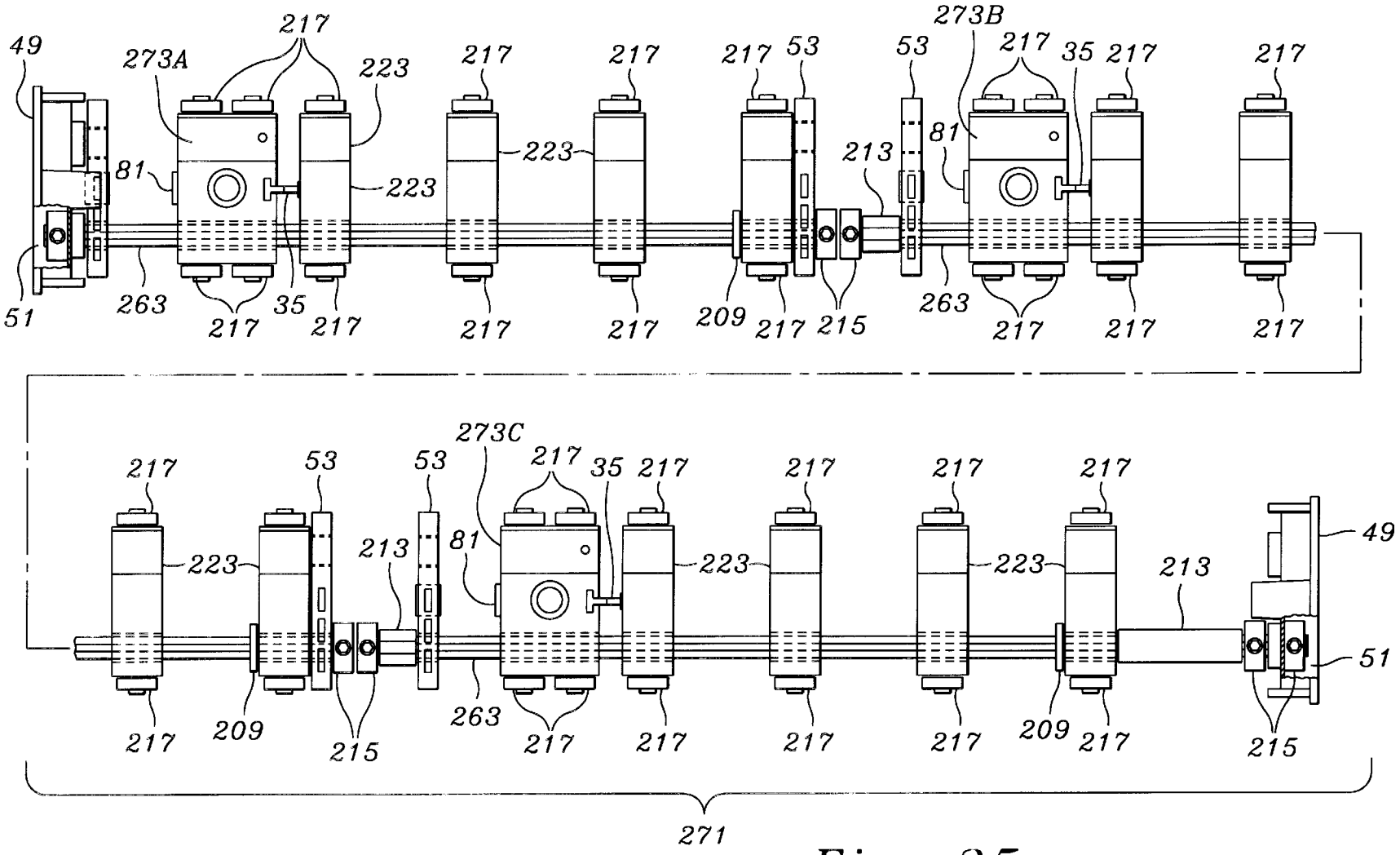
FIG. 25 is a top view, without the track, of a set of three control zones having side closure.

Referring to FIG. 25, an orientation similar to that shown in FIGS. 21–25 is seen and which is a side view of a vertical blind system 251 which is a four zone vertical blind system having three lead carriers, including lead carriers 253A, 253B, 253C and 253D. In this configuration, again because only single control is had, the rotation of any one of the wands 41 of the lead carriers lead carriers 253A, 253B, 253C and 253D will result in rotation of the other two wands. Many additional wands and lead carriers can be used, and one practice which should be followed is the negative mechanical advantaging from the wand 41 to the control rod 207 to help reduce friction when the control rod 207 is passively rotating the other wands 41.

FIG. 24 illustrates an exploded view of a section of a vertical blind system 261, a first zone predominantly seen in FIG. 24 will have a first control rod 263, even though shown in portions, and a second control rod 265 which is also shown in portions. The differences between FIG. 24 and FIG. 20 are best seen near the top of FIG. 24. The spacer 213 may occur at the last of a set of carriers 223 to separate it from a flat member 53 which is used in this case for support. A second flat member 53 is shown in dashed line format behind the flat member 53 most prominently seen in FIG. 24 to illustrate a preferred doubling of the flat members 53 for greater support and stability. The doubled flat members will be hereinafter referred to as a double flat support 267 for clarity. The individual flat members 53 making up the double flat support may have magnets 57 for support and joinability, or they may be bolted together, riveted together, or may be joined in any other acceptable fashion. In addition, the double wide flat member may be formed as an independent item, of somewhat increased thickness.

A short length of the control rod 263 will protrude through double flat support 267 sufficient for the lock ring 215 to fully engage the control rod 263. The control rod 263 then terminates either inside of or just outside of the lock ring 215. Preferably the control rod 263 will have a convex surface to minimize any friction with respect to the end of the adjacent control rod 265, if any such common protrusion occurs. If no protrusion occurs, the adjacent lock rings 215, one of which is shown engaging control rod 263 and the other of which is shown engaging control rod 265 will occasionally rotate against each other. Note that the lock rings 215 carry a set screw which protrudes only from its cylindrical surface, leaving its radial surfaces free to slidably bear against other radial surfaces.

At the bottom of the FIG. 24, the lock ring 215 is attached to the control rod 265, and the control rod 265 may use a spacer 213 to set the separation from another double flat support 267. In the double flat support 267 seen at the bottom of the Figure, a magnet 57 is seen, which can be both used to hold double flat support 267 together, as well as to provide positive closure support for the adjacent lead carrier which will approach from the direction of the track 219.

Referring to FIG. 25, a top view, without the track 219, of a vertical blind system 271 illustrates a set of three control zones having side closure, and wherein the three control zones are each separately and independently controlled by its own lead carrier and wand 41 (not shown). The system 271 has a series of three lead carriers 273A, 273B, and 273C, each of which operate separately and disconnected control rods 263, 265, and 275, each of which are separately actuated by the lead carriers 273A, 273B, and 273C, respectively.

Figure 26:
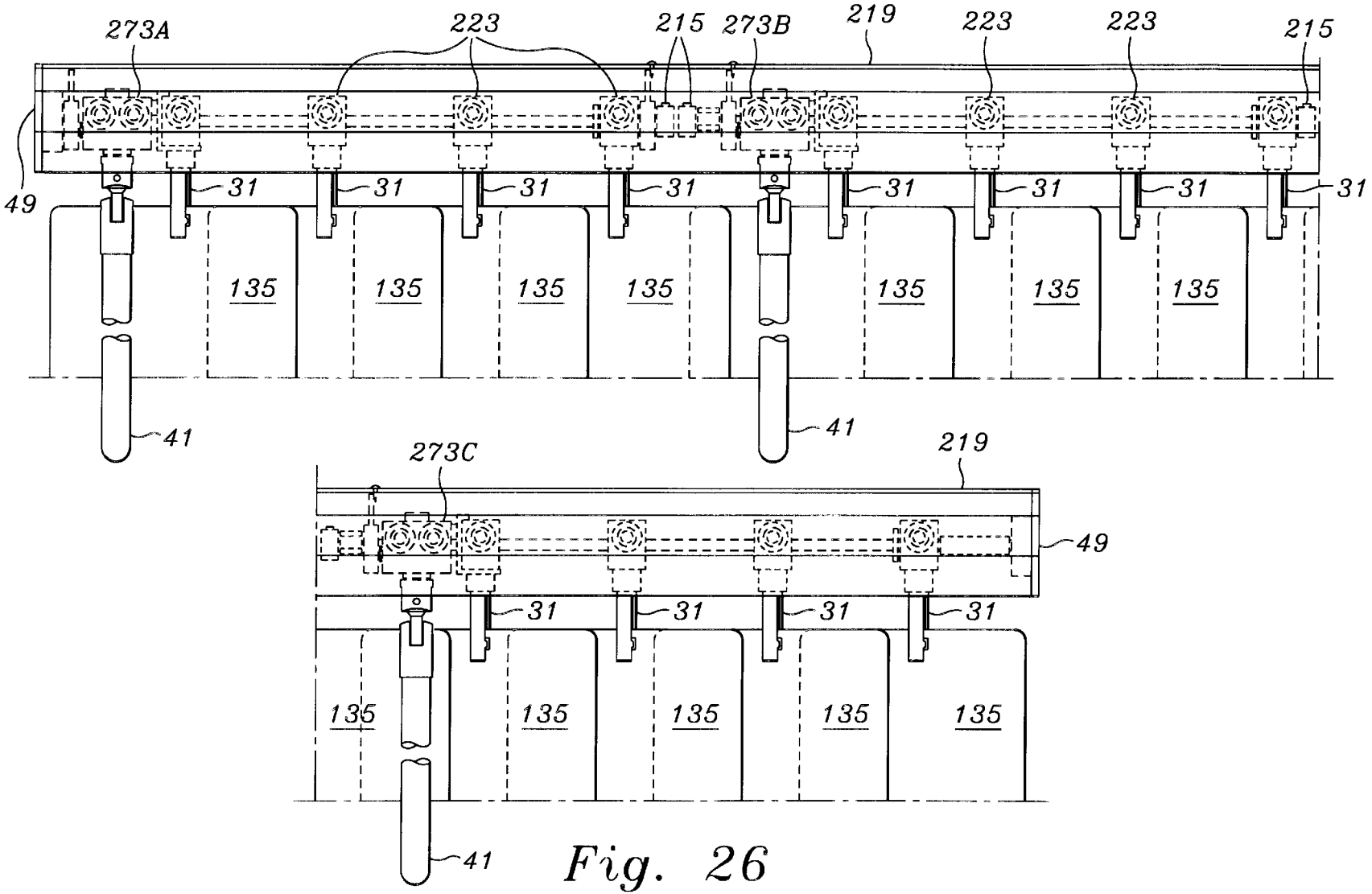
FIG. 26 is a side view of the three control zones of FIG. 27 in closed position.

Note the two instances of a pair of adjoining lock rings 215, and the thin, but discernable space between them. They may occasionally axially translate and bump slightly, but the shown space is to emphasize their independent actuation and rotation. Referring to FIG. 26, a side view of the system of FIG. 25 is shown with vanes 135 and carriers 23 in closed position. Note that closure is effected near the middle by movement of the vane 135 just behind the lead carrier 273B, for example, to overlap the vane 135 of the last of the carriers 223 of the series led by the lead carrier 273A, for example. The four control zones are each separately and independently controlled by its own lead carrier and wand 41, and which use the same technical scheme as seen in FIG. 26. A series of four lead carriers 293A, 293B, 293C, and 293D each provide the control for the four separate zones of both opening and closing, as well as vane control.

Figure 27A:
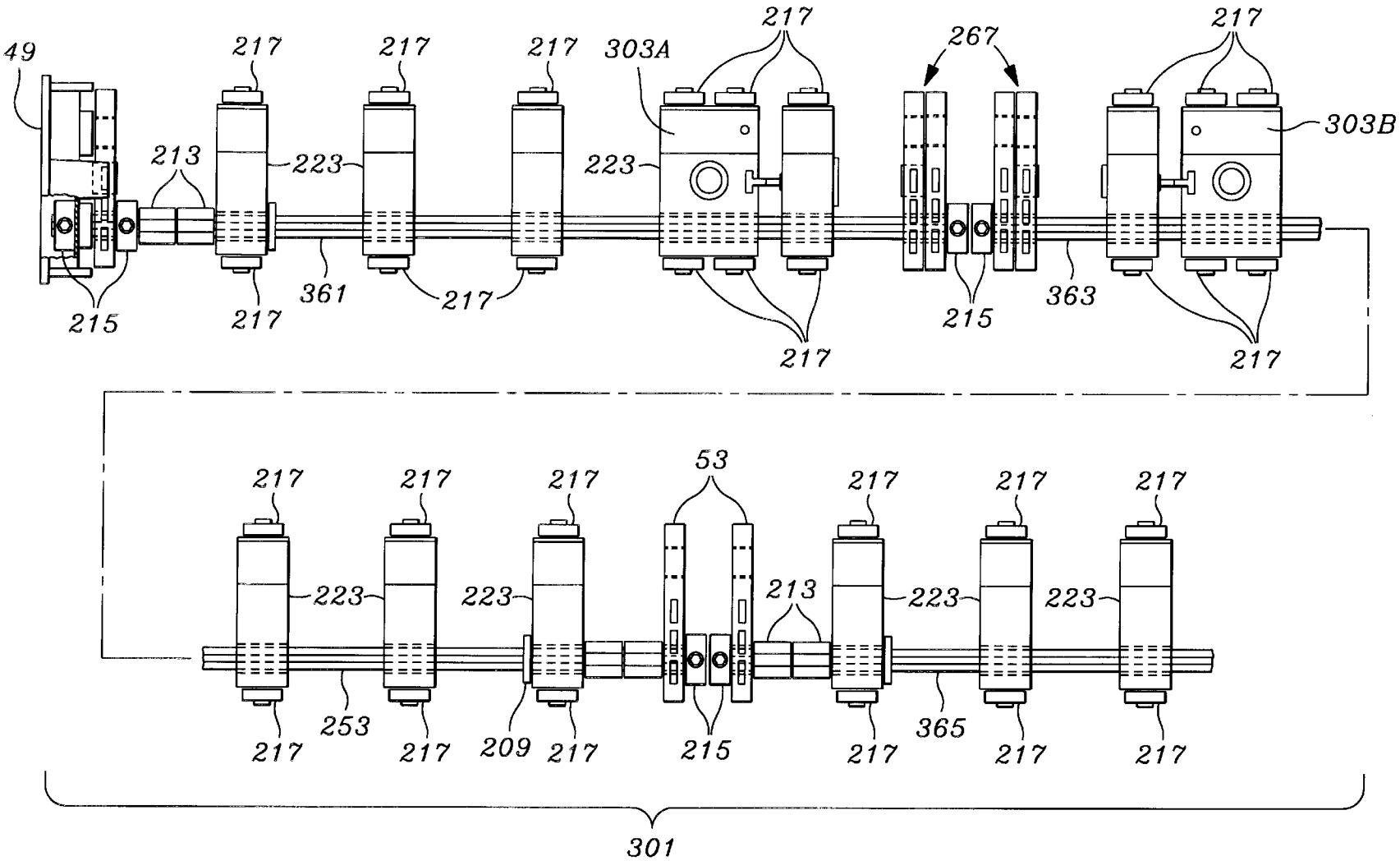
FIGS. 27A & 27B illustrate a top view of a four section independently controlled vertical blind assembly in which the first two consecutive sections and the second two consecutive sections are center open, the second and third section form a center stacking pair.
Figure 27B:
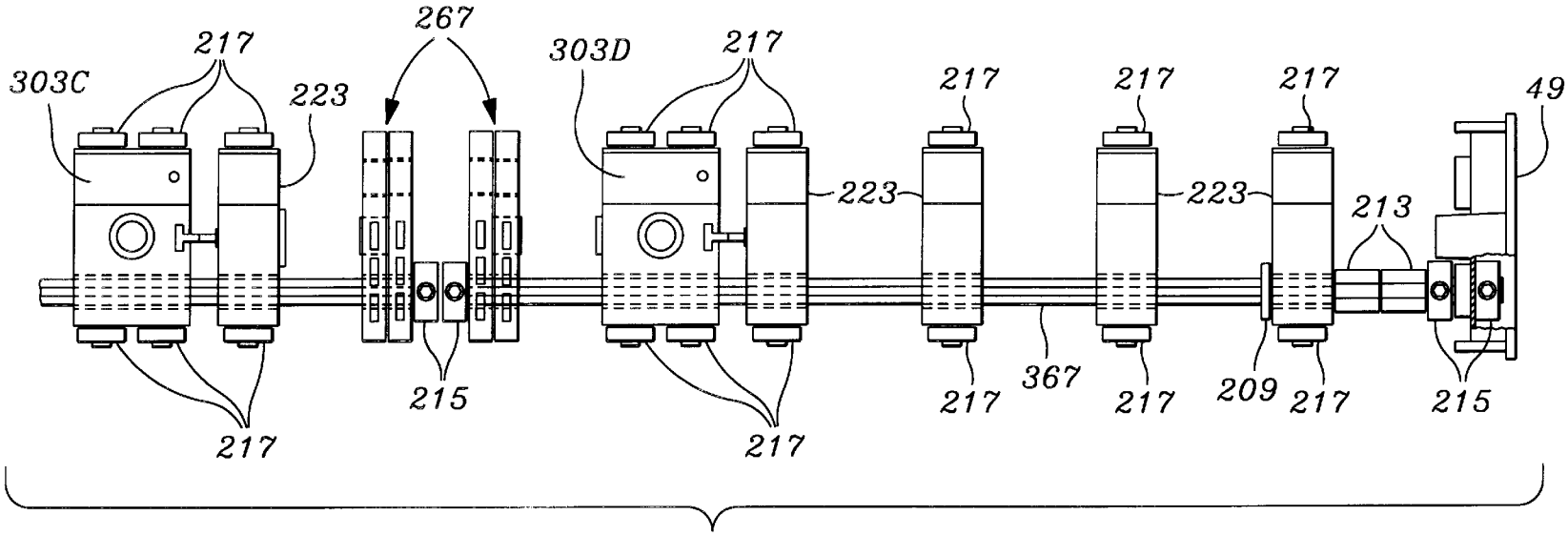

FIGS. 27A & 27B illustrate a top view of a four section independently controlled vertical blind assembly system 301, in which the first two consecutive sections and the second two consecutive sections are center open, the second and third section form a center stacking pair. A set of four carriers 303A, 303B, 303C, and 303D are provided such that carrier 303A and 303B close in a direction toward each other, and where carrier 303C and 303D closes in a direction toward each other. The stacking of the carriers 223 occur to opposite sides and away from the lead carrier pairs 303A & 303B, and to the opposite sides of and away from the lead carrier pairs 303C & 303D. The set of four carriers 303A, 303B, 303C, and 303D, independently control four control rods 361, 363, 365 and 367, respectively.

In FIGS. 27A and 27B, note that a double flat support 267 is used where the lead carriers 303A & 303B, and 303C & 303D meet, and only a single flat member on each side of a pair of opposing lock rings 215 are used at the ends opposite where the lead carriers 303A & 303B, and 303C & 303D meet. This does not necessarily need to be the case, but illustrates one way in which any added weight can be supported.

Figure 27C:
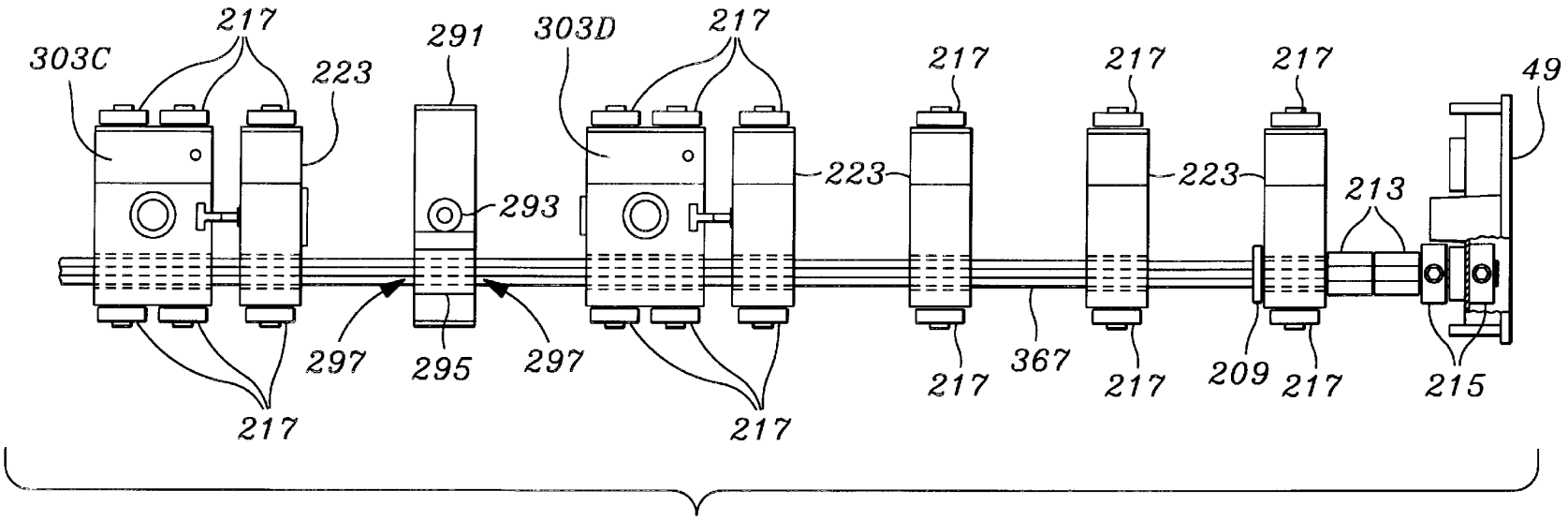
FIG. 27C illustrates an alternative magnet structure which is suspended from a track.

FIG. 27C illustrates an alternative center close component as a double magnet component 291 having a raised boss 293 and a tubular magnet support section 295 supporting two magnets 297. This component 291 is attached to the top of a track through the boss 293 and effectively suspends the magnets 297 on the larger space on one side of the rod?

Figure 28:
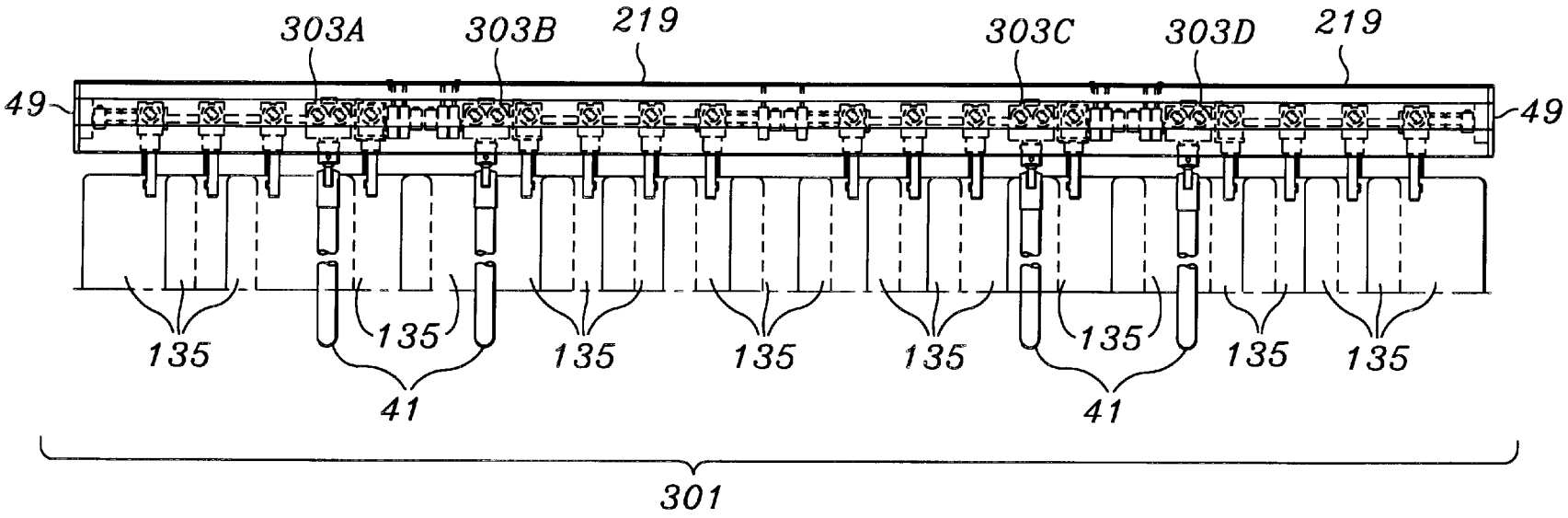
FIG. 28 illustrates a side view of the vertical blind system of FIGS. 27A & 27B.

FIG. 28 illustrates a side view of the vertical blind system seen in FIGS. 27A and 27B.

Figure 29:
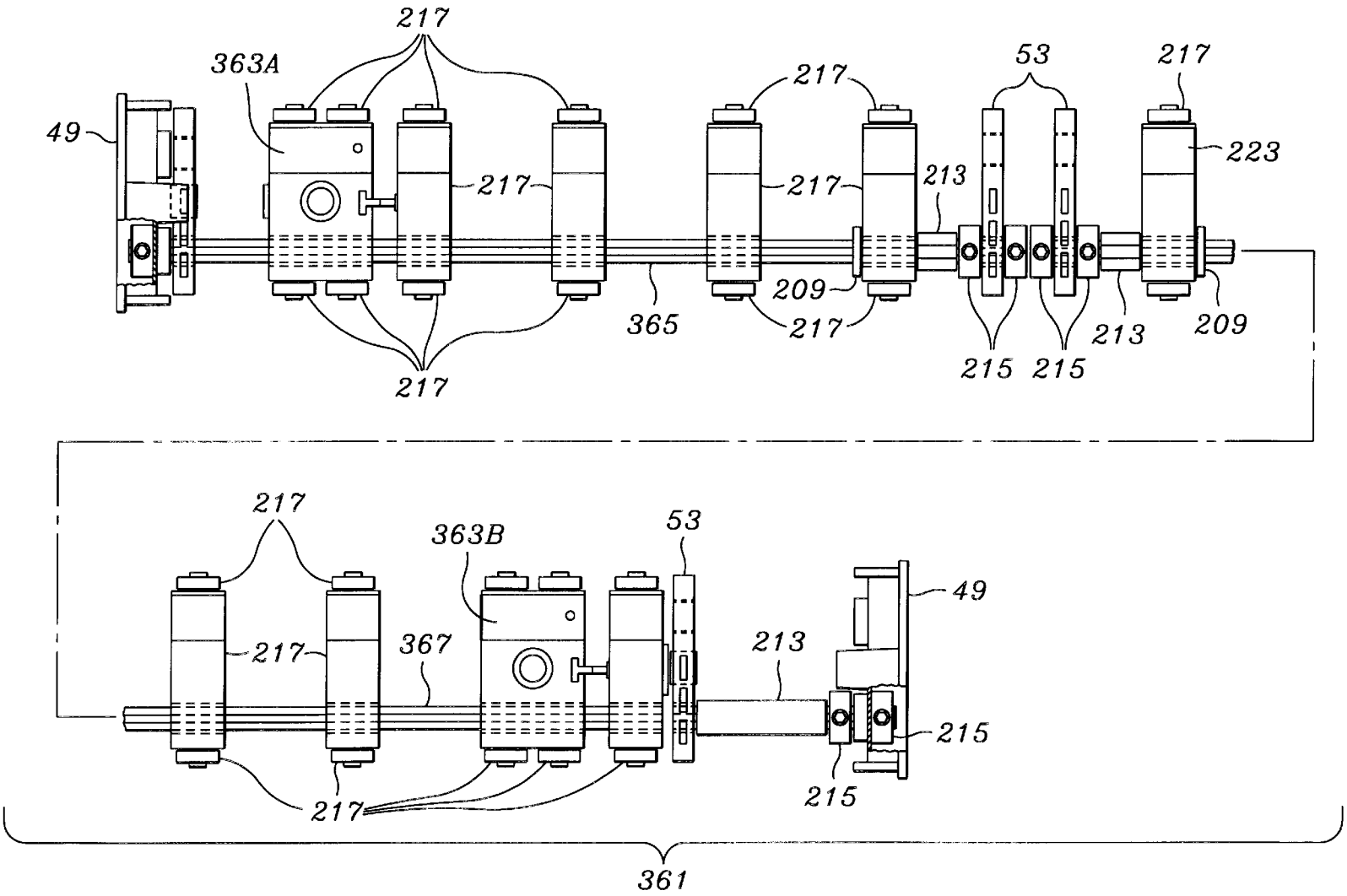
FIG. 29 illustrates a two zone independent control center stacking configuration with separate end wand control lead carriers.

FIG. 29 illustrates a two zone independent control center stacking configuration in a vertical blind system 361. The system 361 adjacent a first end has a first lead carrier 363A and a second with a second lead carrier 363B. Lead Carrier 363A controls a control rod 365 while lead carrier 363B controls a control rod 367. Thus each of the lead carriers 363A and 363B controls its respective half of the system 361 both in terms of extending carriers 223 to a spaced closed position and to a closely stacked open position, as well as to independently actuate the vane positions of each half of the system 361 independently of the other half.

Figure 30:
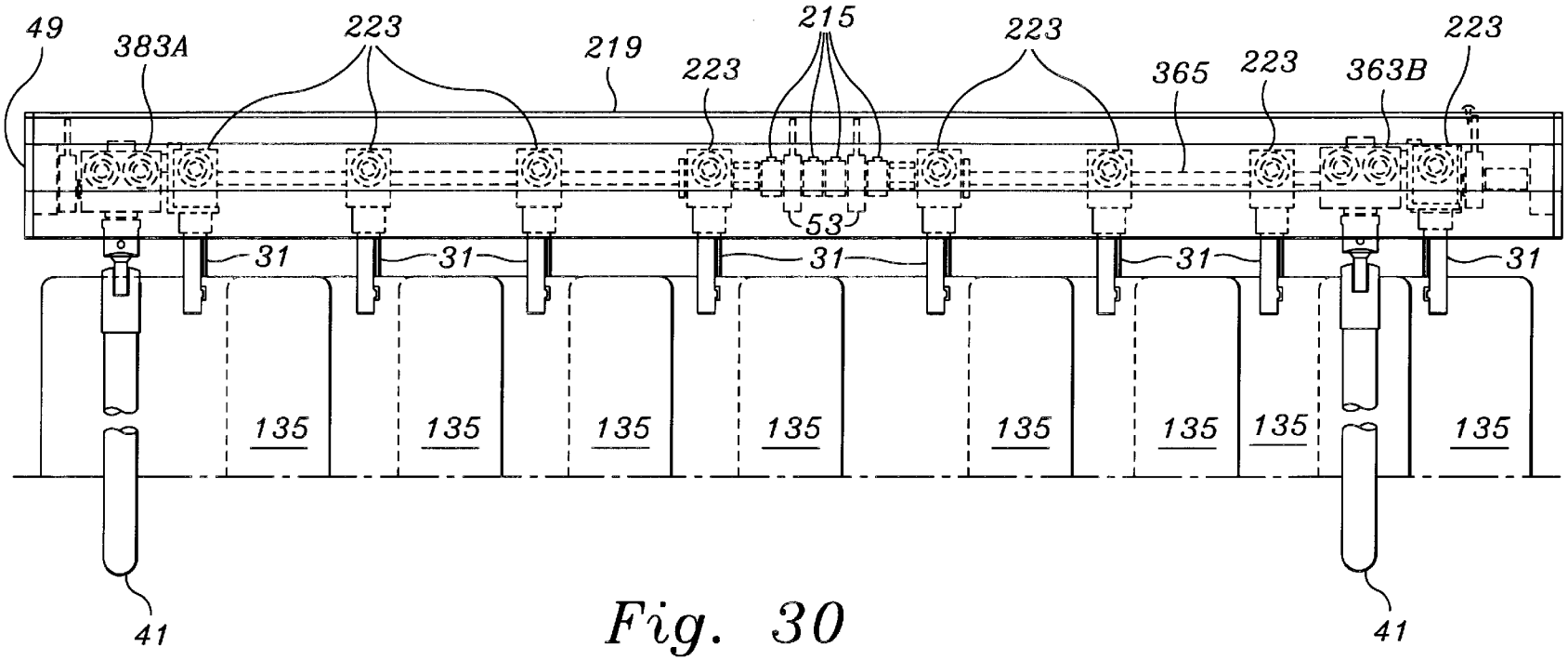
FIG. 30 illustrates a side view of the vertical blind system of FIG. 29.

FIG. 30 illustrates a side view of the vertical blind system of FIG. 29.

Figure 31:
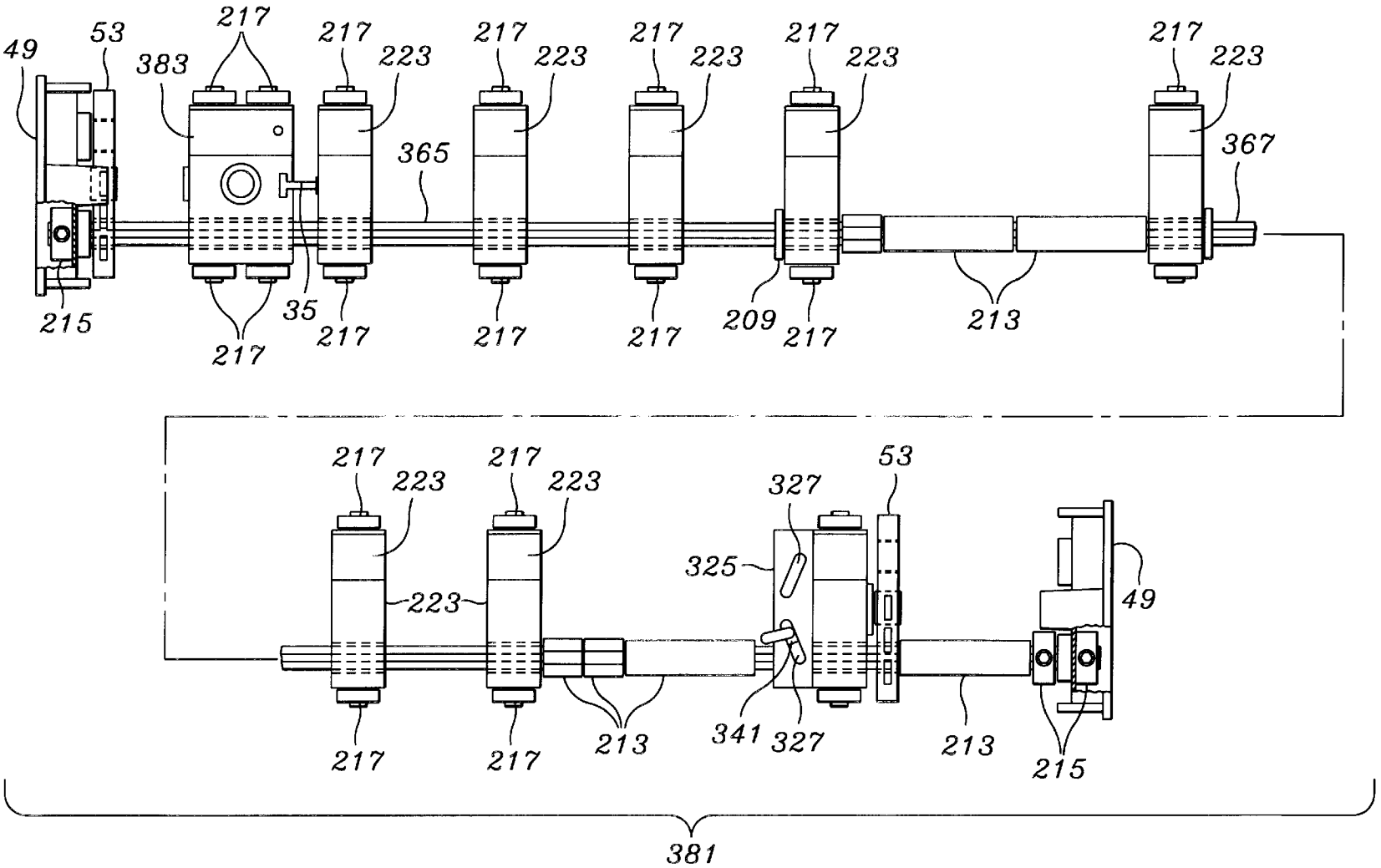
FIG. 31 is a single control zone center stacking configuration having a single control wand carrier at one end and a dummy wand at the other end.

FIG. 31 is a single control zone center stacking configuration of a vertical blind system 381 having a pair of side opening and closing zones and having a single control wand carrier 383, and a single non-operating or dummy wand support 325. Thus the lead carriers 383 controls the complete system, which responds to a control rod 385. The dummy wand 341 is used only to pull half of the system 381 into position.

Figure 32:
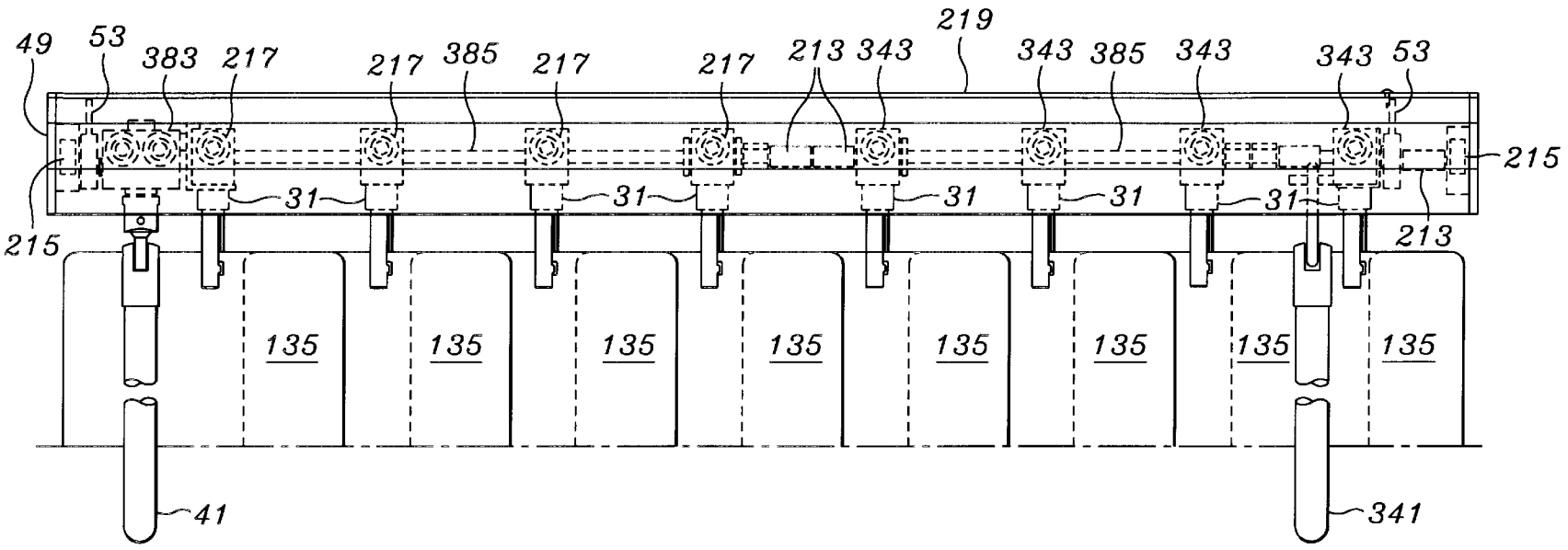
FIG. 32 illustrates a side view of the vertical blind system of FIG. 31.
Figure 33:
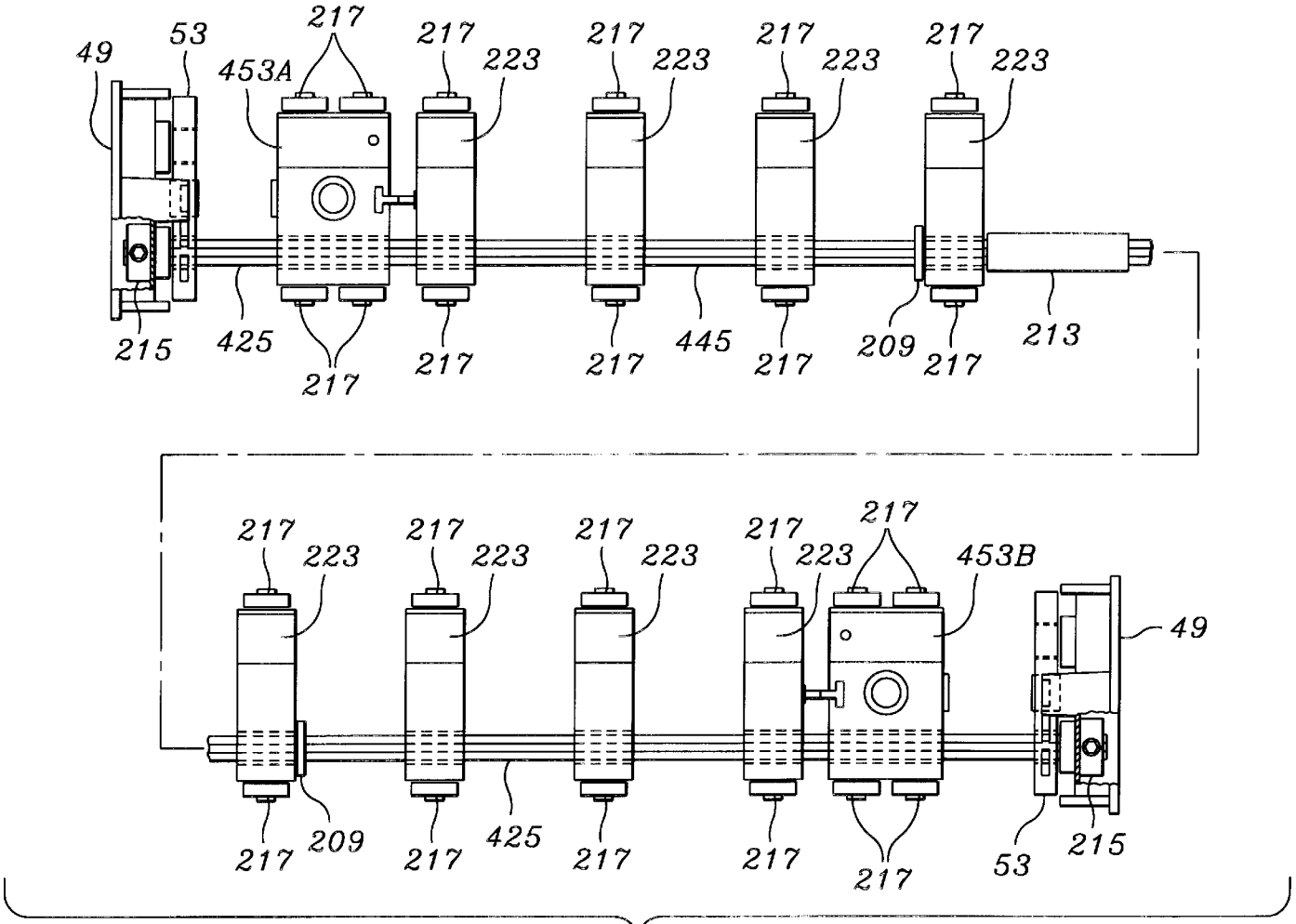
FIG. 33 illustrates a two section, center stacking, non-independent control configuration.

FIG. 32 illustrates a side view of the vertical blind system of FIG. 38;

FIG. 33 illustrates a two zone independent control center stacking configuration in a vertical blind system 451. The system 451 has a first lead carrier 453A and a second with a second lead carrier 453B. Lead Carriers 453A & 453B both control a control rod 445. Thus each of the lead carriers 453A and 453B control the whole of the system 451 both in terms of extending carriers 223 to a spaced closed position and to a closely stacked open position, as well as to independently actuate the vane positions of each half of the system 451. System 451 is a dual control center stacking configuration.

Figure 34:
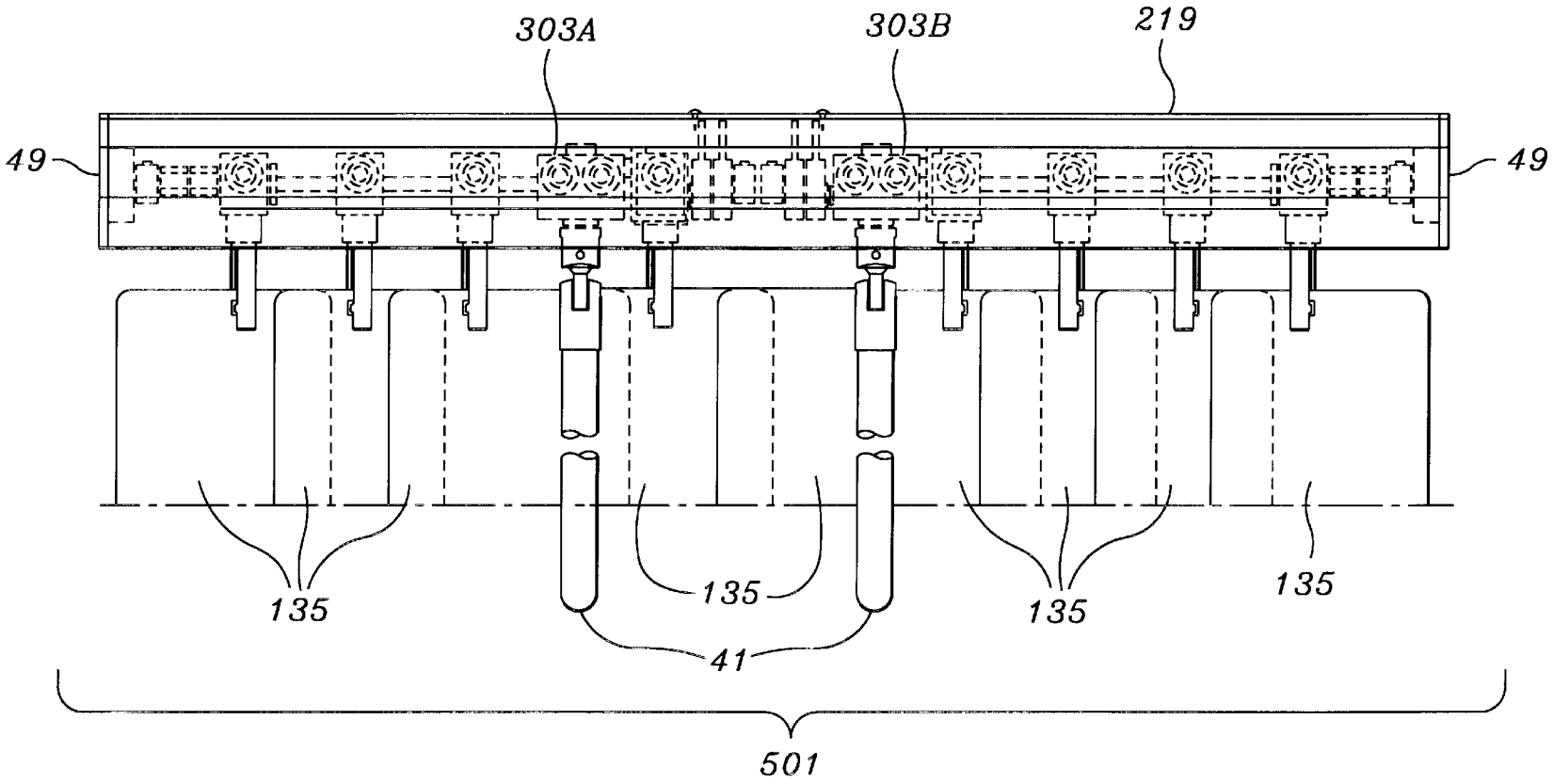
FIG. 34 illustrates a side view of a two section independent control, two wand center draw configuration.

Referring to FIG. 34, a side view of a two zone, two control rod two control wand configuration 501 is illustrated. The components are numbered consistent with FIGS. 27A & 27B.

While the present invention has been described in terms of a vertical blind system, one skilled in the art will realize that the structure and techniques of the present invention can be applied to many similar appliances. The present invention may be applied in any situation where spacing and tolerance distributions are desired to be controlled and supplemented with an absolute and easy to use opening and closing mechanism.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. A multiple section positive closure system for a vertical blind comprising:

an elongate track;

a first pulled carrier having a wand for manual turning input and an internal fitting for translating manual turning input into rotation of a rotatable rod and supported by said elongate track;

a second pulled carrier having a wand;

a plurality of follower carriers each having an internal rotatable sleeve engaging said rotatable rod, and a rotatable blind support linked to turn in response to rotation of said rotatable rod, a first number of said plurality of follower carriers associated with and translatable in response to pulling said first pulled carrier and a second number of said plurality of follower carriers associated with and translatable in response to pulling of said second pulled carrier;

a first magnetically attractable structure supported by said first pulled carrier and a second magnetically attractable structure supported by said second pulled carrier; and a third magnetically attractable structure supported by said elongate track and for providing positive closure with at least one of said first and said second pulled carriers.

2. The multiple section positive closure system for a vertical blind as recited in claim 1 wherein said third magnetically attractable structure is at least one flat member supported by said track and carrying a first magnet and having a first aperture surrounding said rotatable rod.

3. The multiple section positive closure system for a vertical blind as recited in claim 1 wherein said third magnetically attractable structure is a double magnet component having a raised boss and a tubular magnet support section and supported by said track.

4. A multiple section positive closure system for a vertical blind comprising:

an elongate track;

at least a first and a second rotatable control rod supported within said elongate track;

at least a first and a second pulled carrier having a wand for manual turning input and an internal fitting for translating manual turning input into rotation of said first and said second rotatable rods, respectively, and supported by said elongate track;

a plurality of follower carriers each having an internal rotatable sleeve engaging said rotatable rod, and a rotatable blind support linked to turn in response to rotation of said rotatable rod, a number of said plurality of follower carriers associated with and translatable in response to pulling of each of said first and second pulled carriers;

a first and a second magnetically attractable structure each supported by an associated one of said first and second pulled carriers;

a third magnetically attractable structure supported by said elongate track for providing positive closure with associated ones of said first and second pulled carriers.

* * * * *